US012024394B2

(12) United States Patent
Sakai

(10) Patent No.: US 12,024,394 B2
(45) Date of Patent: Jul. 2, 2024

(54) MEDIUM CONVEYING APPARATUS TO EXECUTE ABNORMALITY PROCESSING FOR MULTI-FEED BASED ON OVERLAP DETECTION WIDTH

(71) Applicant: PFU LIMITED, Kahoku (JP)

(72) Inventor: Masaaki Sakai, Kahoku (JP)

(73) Assignee: PFU LIMITED, Kahoku (JP)

( * ) Notice: Subject to any disclaimer, the term of this patent is extended or adjusted under 35 U.S.C. 154(b) by 227 days.

(21) Appl. No.: 17/649,607

(22) Filed: Feb. 1, 2022

(65) Prior Publication Data

US 2022/0274795 A1 Sep. 1, 2022

(30) Foreign Application Priority Data

Feb. 26, 2021 (JP) ..... 2021-030542

(51) Int. Cl.
*B65H 7/12* (2006.01)

(52) U.S. Cl.
CPC ..... *B65H 7/125* (2013.01); *B65H 2511/12* (2013.01); *B65H 2511/524* (2013.01); *B65H 2553/30* (2013.01); *B65H 2801/03* (2013.01)

(58) Field of Classification Search
CPC .... B65H 7/125; B65H 7/12; B65H 2511/524; B65H 2511/12; B65H 2553/30; G03G 2215/00333; G03G 2215/0035; G03G 2215/00548
See application file for complete search history.

(56) References Cited

U.S. PATENT DOCUMENTS

| | | | | |
|---|---|---|---|---|
| 7,822,376 | B2 * | 10/2010 | Nagano | G03G 15/6511 399/388 |
| 2005/0228535 | A1 | 10/2005 | Simonis et al. | |
| 2012/0025458 | A1 | 2/2012 | Simonis et al. | |
| 2020/0079608 | A1 * | 3/2020 | Hall | H04N 1/00801 |
| 2021/0155430 | A1 * | 5/2021 | Furukawa | H04N 1/00591 |

FOREIGN PATENT DOCUMENTS

| | | | |
|---|---|---|---|
| JP | 7-291485 | A | 11/1995 |
| JP | 2007-281777 | A | 10/2007 |
| JP | 2007331909 | A * | 12/2007 |
| JP | 2016-222451 | A | 12/2016 |
| JP | 2019-193219 | A | 10/2019 |

* cited by examiner

*Primary Examiner* — Luis A Gonzalez
(74) *Attorney, Agent, or Firm* — LEWIS ROCA ROTHGERBER CHRISTIE LLP

(57) ABSTRACT

A medium conveying apparatus includes a conveying roller to convey a medium, a width detection sensor for detecting a width of the medium conveyed by the conveying roller in a direction perpendicular to a conveying direction, an overlap detection sensor for detecting an overlap of the medium conveyed by the conveying roller, and a processor to determine whether to execute an abnormality processing for a multi-feed, based on the width of the medium acquired based on a detection result by the width detection sensor and a detection result by the overlap detection sensor. The processor acquires an overlap detection width being a width in which the medium is estimated to overlap in the direction perpendicular to the conveying direction, based on the detection result by the overlap detection sensor. The processor executes the abnormality processing when the width of the medium and the overlap detection width are equal.

15 Claims, 13 Drawing Sheets

MEDIUM CONVEYING APPARATUS TO EXECUTE ABNORMALITY PROCESSING FOR MULTI-FEED BASED ON OVERLAP DETECTION WIDTH

CROSS-REFERENCE TO RELATED APPLICATIONS

This application is based upon and claims the benefit of priority of prior Japanese Patent Application No. 2021-030542, filed on Feb . 26, 2021, the entire contents of which are incorporated herein by reference.

TECHNICAL FIELD

Embodiments discussed in the present specification relate to medium conveyance.

BACKGROUND

In general, a medium conveying apparatus such as a scanner has a function of detecting whether or not a multi-feed, that is, a plurality of media being conveyed in an overlapping manner has occurred, and automatically stopping the conveyance of the medium when the multi-feed has occurred.

For example, a document feeding apparatus which reciprocates a multi-feed detection sensor to detect a multi-feed of a document when the document is conveyed in an overlapped state, in a direction perpendicular to a document conveying direction, and determines the multi-feed of the document based on a multi-feed detection signal detected by the multi-feed detection sensor, is disclosed (Japanese Unexamined Patent Publication (Kokai) No. 2007-281777). The document feeding apparatus determines that the multi-feed of the document has occurred when the multi-feed detection signal is detected with a width equal to or more than a predetermined value in a width direction perpendicular to the document conveying direction.

Further, a medium conveying apparatus provided with a first sensor located on one end side of a conveying path of a medium, to detect a passage and a multi-feed of the medium, and a second sensor located on the other end side of the conveying path, to detect the passage and the multi-feed of the medium, is disclosed (Japanese Unexamined Patent Publication (Kokai) No. 2019-193219). The medium conveying apparatus determines whether or not the multi-feed of the medium has occurred based on a detection result of each of the first sensor and the second sensor.

SUMMARY

According to some embodiments, a medium conveying apparatus includes a conveying roller to convey a medium, a width detection sensor for detecting a width of the medium conveyed by the conveying roller in a direction perpendicular to a conveying direction, an overlap detection sensor for detecting an overlap of the medium conveyed by the conveying roller, and a processor to determine whether to execute an abnormality processing for a multi-feed, based on the width of the medium acquired based on a detection result by the width detection sensor and a detection result by the overlap detection sensor. The processor acquires an overlap detection width being a width in which the medium is estimated to overlap in the direction perpendicular to the conveying direction, based on the detection result by the overlap detection sensor. The processor executes the abnormality processing when the width of the medium and the overlap detection width are equal.

According to some embodiments, a method for executing an abnormality processing, includes, conveying a medium, by a conveying roller, determining whether to execute an abnormality processing for a multi-feed, based on a width of the medium acquired based on a detection result by a width detection sensor for detecting a width of the medium conveyed by the conveying roller in a direction perpendicular to a conveying direction and a detection result by an overlap detection sensor for detecting an overlap of the medium conveyed by the conveying roller. An overlap detection width being a width in which the medium is estimated to overlap in the direction perpendicular to the conveying direction, is acquired based on the detection result by the overlap detection sensor. The abnormality processing is executed when the width of the medium and the overlap detection width are equal.

According to some embodiments, a computer-readable, non-transitory medium stores a computer program. The computer program causes a medium conveying apparatus including a conveying roller to convey a medium, a width detection sensor for detecting a width of the medium conveyed by the conveying roller in a direction perpendicular to a conveying direction, and an overlap detection sensor for detecting an overlap of the medium conveyed by the conveying roller, to execute a process including determining whether to execute an abnormality processing for a multi-feed, based on the width of the medium acquired based on a detection result by the width detection sensor and a detection result by the overlap detection sensor. An overlap detection width being a width in which the medium is estimated to overlap in the direction perpendicular to the conveying direction, is acquired based on the detection result by the overlap detection sensor. The abnormality processing is executed when the width of the medium and the overlap detection width are equal

DESCRIPTION OF EMBODIMENTS

It is to be understood that both the foregoing general description and the following detailed description are exemplary and explanatory, and are not restrictive of the invention, as claimed.

Hereinafter, a medium conveying apparatus, a method for executing an abnormality processing, and a computer-readable, non-transitory medium storing a computer program according to an embodiment, will be described with reference to the drawings. However, it should be noted that the technical scope of the invention is not limited to these embodiments, and extends to the inventions described in the claims and their equivalents.

Figure 1:
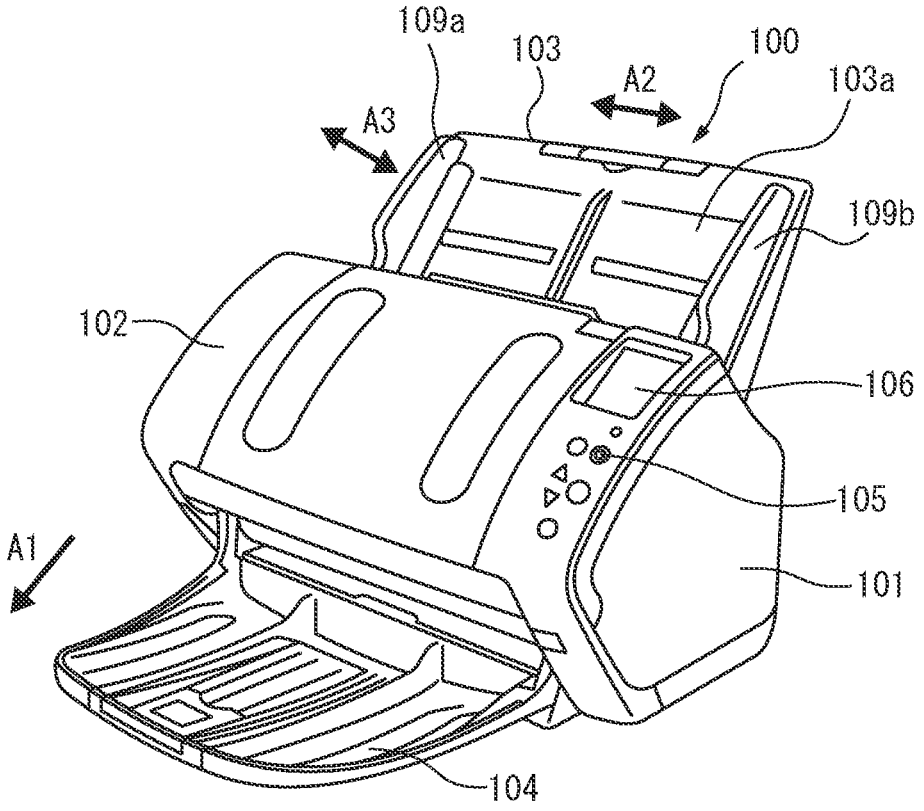
FIG. 1 is a perspective view illustrating a medium conveying apparatus 100 according to the embodiment.

FIG. 1 is a perspective view illustrating a medium conveying apparatus 100 according to an embodiment configured as an image scanner. The medium conveying apparatus 100 conveys and images a medium being a document. The medium is a paper, a card, a booklet, etc. The paper includes thin paper or cardboard, etc. The booklet includes a passport or a passbook, etc. The medium also includes a medium on which adhered object, such as a label (a seal) or a small size paper piece (a photograph, a cutout, a postage stamp, a revenue stamp, etc.), is adhered. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The medium conveying apparatus 100 includes a lower housing 101, an upper housing 102, a medium tray 103, an ejection tray 104, an operation device 105, and a display device 106.

The upper housing 102 is located at a position covering the upper surface of the medium conveying apparatus 100 and is engaged with the lower housing 101 by hinges so as to be opened and closed at a time of medium jam, during cleaning the inside of the medium conveying apparatus 100, etc.

A top surface of the lower housing 101 forms a lower guide 107*a* of a conveyance path of a medium, and a bottom surface of the upper housing 102 forms an upper guide 107*b* of the conveyance path of a medium. An arrow A1 in FIG. 1 indicates a medium conveying direction. Hereinafter, an upstream refers to an upstream in the medium conveying direction A1, and a downstream refers to a downstream in the medium conveying direction A1.

The medium tray 103 is engaged with the lower housing 101 in such a way as to be able to place a medium to be conveyed. The medium tray 103 has a placing surface 103*a* on which a medium is placed. A first side guide 109*a* and a second side guide 109*b* are provided on the placing surface 103*a*. The first side guide 109*a* and the second side guide 109*b* regulate a position of the medium in the width direction A2. Hereinafter, the first side guide 109*a* and the second side guide 109*b* may be collectively referred to as side guides 109. Each side guide 109*a*, 109*b* is movably provided in the width direction A2 perpendicular to the medium conveying direction on the medium tray 103. Each side guide 109*a*, 109*b* has a predetermined height in the height direction A3, to regulate the width direction of the medium placed on the medium tray 103. The first side guide 109*a* and the second side guide 109*b* are movably provided so as to be located at positions symmetrical with respect to a center position on the medium tray 103 in the width direction A2 perpendicular to the medium conveying direction. One of the first side guide 109*a* and the second side guide 109*b* may be fixed to a position on one end side on the medium tray 103, and the other may be provided so as to be movable according to the width of the medium, in the width direction A2 perpendicular to the medium conveying direction.

The ejection tray 104 is engaged with the lower housing 101 in such a way as to be able to hold an ejected medium.

The operation device 105 includes an input device such as a button, and an interface circuit acquiring a signal from the input device, receives an input operation by a user, and outputs an operation signal based on the input operation by the user. The display device 106 includes a display including a liquid crystal or organic electro-luminescence (EL), and an interface circuit for outputting image data to the display, and displays the image data on the display.

Figure 2:
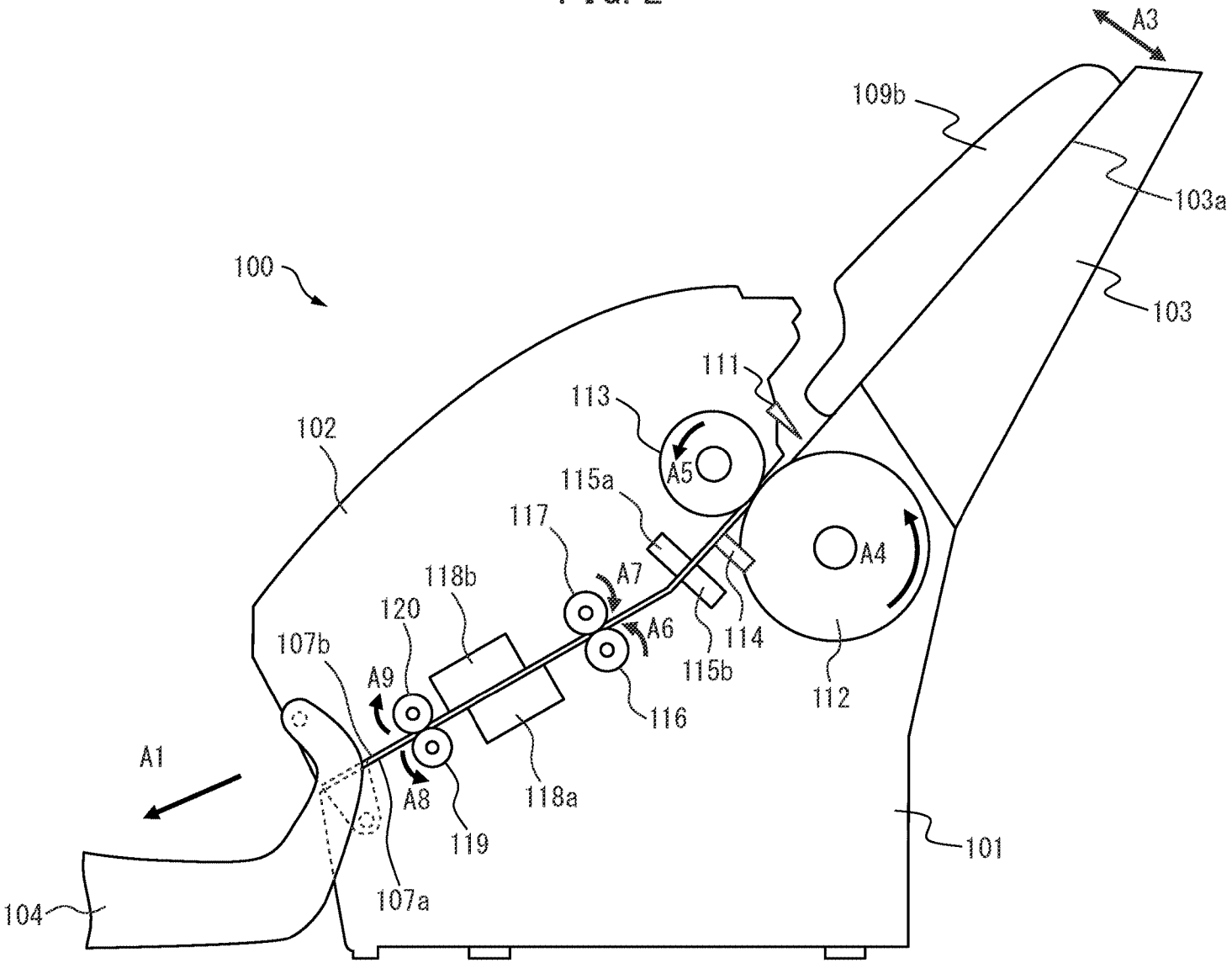
FIG. 2 is a diagram for illustrating a conveyance path inside the medium conveying apparatus 100.

FIG. 2 is a diagram for illustrating a conveyance path inside the medium conveying apparatus 100.

A conveyance path inside the medium conveying apparatus 100, includes a contact sensor 111, a feed roller 112, a brake roller 113, a medium sensor 114, an ultrasonic transmitter 115*a*, an ultrasonic receiver 115*b*, a first conveyance roller 116, a second conveyance roller 117, a first imaging device 118a, a second imaging device 118*b*, a third conveyance roller 119 and a fourth conveyance roller 120, etc. The feed roller 112, the brake roller 113, the first conveyance roller 116 and the second conveyance roller 117 are examples of a conveying roller to convey a medium. The number of each roller is not limited to one, and may be plural. The first imaging device 118*a* and the second imaging device 118*b* may be collectively referred to as the imaging device 118.

The contact sensor 111 is located on the upstream side of the feed roller 112 and the brake roller 113. The contact sensor 111 detects whether or not the medium is placed on the medium tray 103 by the contact detection of the medium. The contact sensor 111 generates and outputs a first medium signal whose signal value changes in a state where the medium is placed on the medium tray 103 and a state where the medium is not placed.

The feed roller 112 is provided on the lower housing 101, and sequentially feeds media placed on the medium tray 103 from the lower side. The brake roller 113 is provided in the upper housing 102, and is located to face the feed roller 112.

The medium sensor 114 is located on the downstream side of the feed roller 112 and the brake roller 113 and on the upstream side of the first conveyance roller 116 and the second conveyance roller 117. In particular, the medium sensor 114 is located between the feed roller 112, and the ultrasonic transmitter 115*a* and the ultrasonic receiver 115*b*in the medium conveying direction A1, The medium sensor 114 detects whether or not the medium exists at the position. The medium sensor 114 includes a light emitter and a light receiver provided on one side with respect to the conveyance path of the medium, and a reflection member such as a mirror provided at a position facing the light emitter and the light receiver with the conveyance path in between (not shown). The light emitter emits light toward the conveyance path. On the other hand, the light receiver receives light projected by the light emitter and reflected by the reflection member, and generates and outputs a second medium signal being an electric signal based on intensity of the received light. Since the light emitted by the light emitter is shielded by the medium when the medium is present at the position of the medium sensor 114, the signal value of the second medium signal is changed in a state where the medium is present at the position of the medium sensor 114 and a state where the medium is not present. The light emitter and the light receiver may be provided at positions facing one another with the conveyance path in between, and the reflection member may be omitted.

The ultrasonic transmitter 115*a* and the ultrasonic receiver 115*b*are located on the downstream side of the feed roller 112 and the brake roller 113 and on the upstream side of the first conveyance roller 116 and the second conveyance roller 117 in the medium conveying direction A1, The ultrasonic transmitter 115*a* and the ultrasonic receiver 115*b*are located close to the conveyance path of a medium in such a way as to face one another with the conveyance path in between. The ultrasonic transmitter 115*a* is capable of outputting an ultrasonic wave. On the other hand, the ultrasonic receiver 115*b*receives an ultrasonic wave being transmitted by the ultrasonic transmitter 115*a* and passing through a medium, and generates and outputs an ultrasonic signal being an electric signal corresponding to the received ultrasonic wave. Hereinafter, the ultrasonic transmitter 115*a* and the ultrasonic receiver 115*b*may be collectively referred to as an ultrasonic sensor 115. The ultrasonic sensor 115 detects the transmission intensity of the ultrasonic wave transmitted through the medium. The ultrasonic sensor 115 is an example of an overlap detection sensor and a detection sensor, and detects an overlap of the medium conveyed by the conveying roller, in a detection area being an area on the medium passing over the ultrasonic receiver 115*b*.

The first conveyance roller 116 and the second conveyance roller 117 are located on the downstream side of the feeding roller 112 and the brake roller 113 and on the upstream side of the imaging device 118 in the medium conveying direction A1.

The first imaging device 118*a* is located on the downstream side of the first conveyance roller 116 and the second conveyance roller 117 in the medium conveying direction A1, The first imaging device 118*a* includes a line sensor based on a unity-magnification optical system type contact image sensor (CIS) including an imaging element based on a complementary metal oxide semiconductor (CMOS) linearly located in a main scanning direction. The main scanning direction is a direction perpendicular to the medium conveying direction. The line sensor is an example of an imaging sensor to image a medium. The first image pickup device 118*a* includes a light source to irradiate light toward the conveyed medium, a lens for forming an image on the imaging element, and an AID converter for amplifying and analog-digital (AID) converting an electric signal output from the imaging element. The first imaging device 118*a* sequentially generates and outputs line images acquired by imaging an area of a front surface of the conveyed medium facing the line sensor at certain intervals. Specifically, a pixel count of a line image in a vertical direction (sub-scanning direction) is 1, and a pixel count in a horizontal direction (main scanning direction) is larger than 1. The first imaging device 118*a* is an example of a width detection sensor, and is used for detecting the width of the medium conveyed by the conveying roller in the width direction A2 perpendicular to the conveying direction.

Similarly, the second imaging device 118*b* is located on the downstream side of the first conveyance roller 116 and the second conveyance roller 117 in the medium conveying direction A1, The second imaging device 118*b* includes a line sensor based on a unity-magnification optical system type CIS including an imaging element based on a CMOS linearly located in a main scanning direction. The line sensor is an example of an imaging sensor to image a medium. Further, the second imaging device 118*b* includes a light source to irradiate light toward the conveyed medium, a lens for forming an image on the imaging element, and an AID converter for amplifying and analog-digital (AID) converting an electric signal output from the imaging element. The second imaging device 118*b* sequentially generates and outputs line images acquired by imaging an area of a back surface of the conveyed medium facing the line sensor at certain intervals. The second imaging device 118*b* is an example of a width detection sensor, and is used for detecting a width of the medium conveyed by the conveying roller in the width direction A2 perpendicular to the conveying direction.

Only either of the first imaging device 118*a* and the second imaging device 118*b* may be located in the medium conveying apparatus 100 and only one surface of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs.

A medium placed on the medium tray 103 is conveyed between the lower guide 107*a* and the upper guide 107*b* in the medium conveying direction A1 by the feed roller 112 rotating in a direction of an arrow A4 in FIG. 2. When a medium is conveyed, the brake roller 113 rotates in a direction of an arrow A3. By the workings of the feed roller 112 and the brake roller 113, when a plurality of media are placed on the medium tray 103, only a medium in contact with the feed roller 112, out of the media placed on the medium tray 103, is separated. Consequently, the medium conveying apparatus 100 operates in such a way that conveyance of a medium other than the separated medium is restricted (prevention of multi-feed). The feed roller 112 and the brake roller 113 are an example of a feeding roller to feed by separating the medium placed on the medium tray 103.

The medium is fed between the first conveyance roller 116 and the second conveyance roller 117 while being guided by the lower guide 107*a* and the upper guide 107*b*. The medium is fed between the first imaging device 118*a* and the second imaging device 118*b* by the first conveyance roller 116 and the second conveyance roller 117 rotating in directions of an arrow A6 and an arrow A7, respectively. The medium read by the imaging devices 118 is ejected on the ejection tray 104 by the third conveyance roller 119 and the fourth conveyance roller 120 rotating in directions of an arrow A8 and an arrow A9, respectively.

Figure 3:
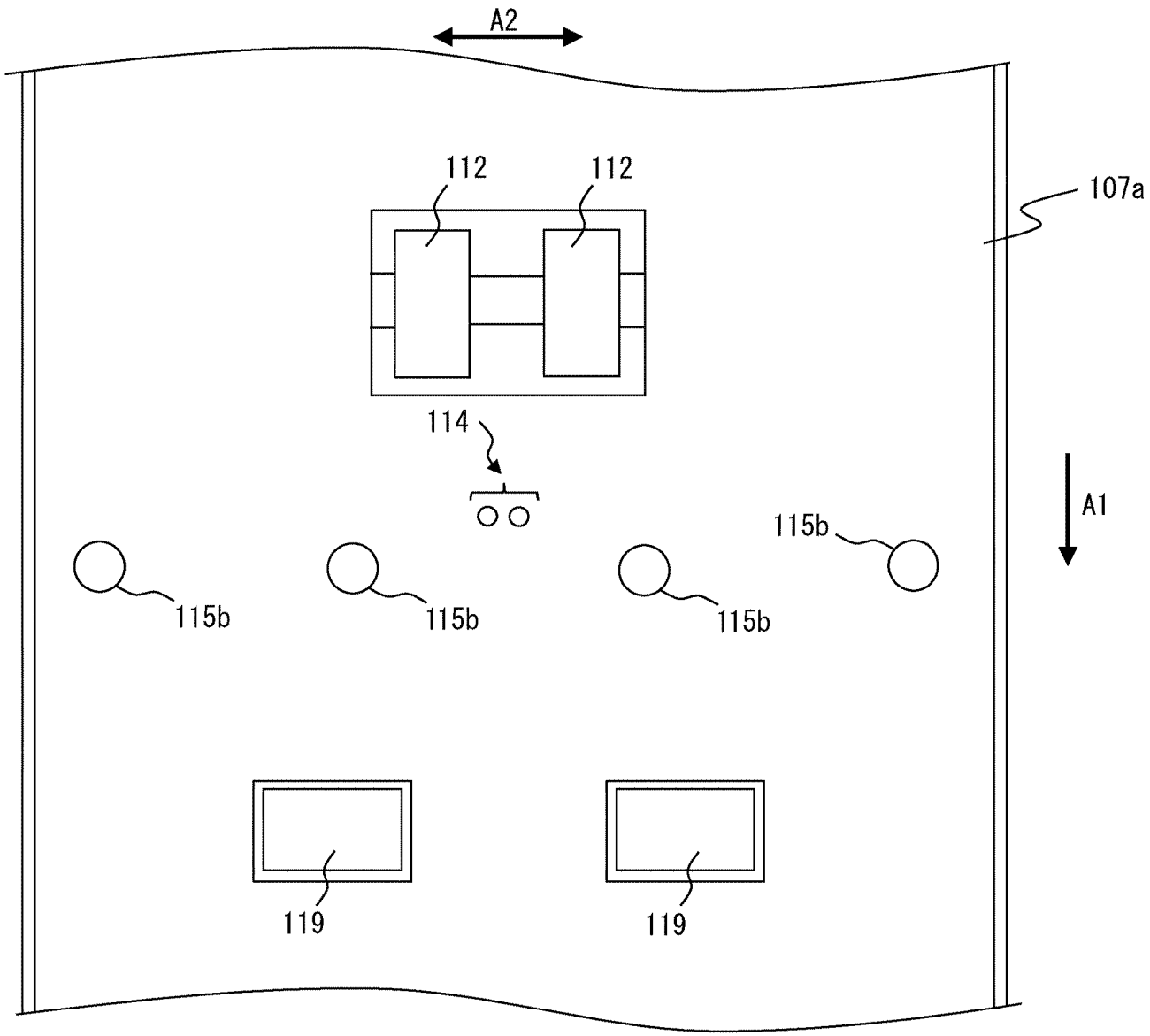
FIG. 3 is a schematic diagram for illustrating an arrangement of an ultrasonic sensor 115, etc.

FIG. 3 is a schematic diagram for illustrating an arrangement of the ultrasonic sensor 115, etc.

FIG. 3 is a schematic diagram of the lower guide 107*a* as viewed from above in a state in which the upper housing 102 is opened. In the example shown in FIG. 3, four ultrasonic sensors 115 are located apart from each other along in the width direction A2. In particular, each ultrasonic sensor 115 is evenly spaced in the width direction A2. The ultrasonic sensor $\mathbf{115}_S$ located outermost among from the four ultrasonic sensors 115 are located at both ends of the lower guide 107*a* in the width direction A2, so that they detect overlap at both ends of the medium in the width direction A2. The number of ultrasonic sensors 115 is not limited to four, and may be three or less, or five or more.

Figure 4:
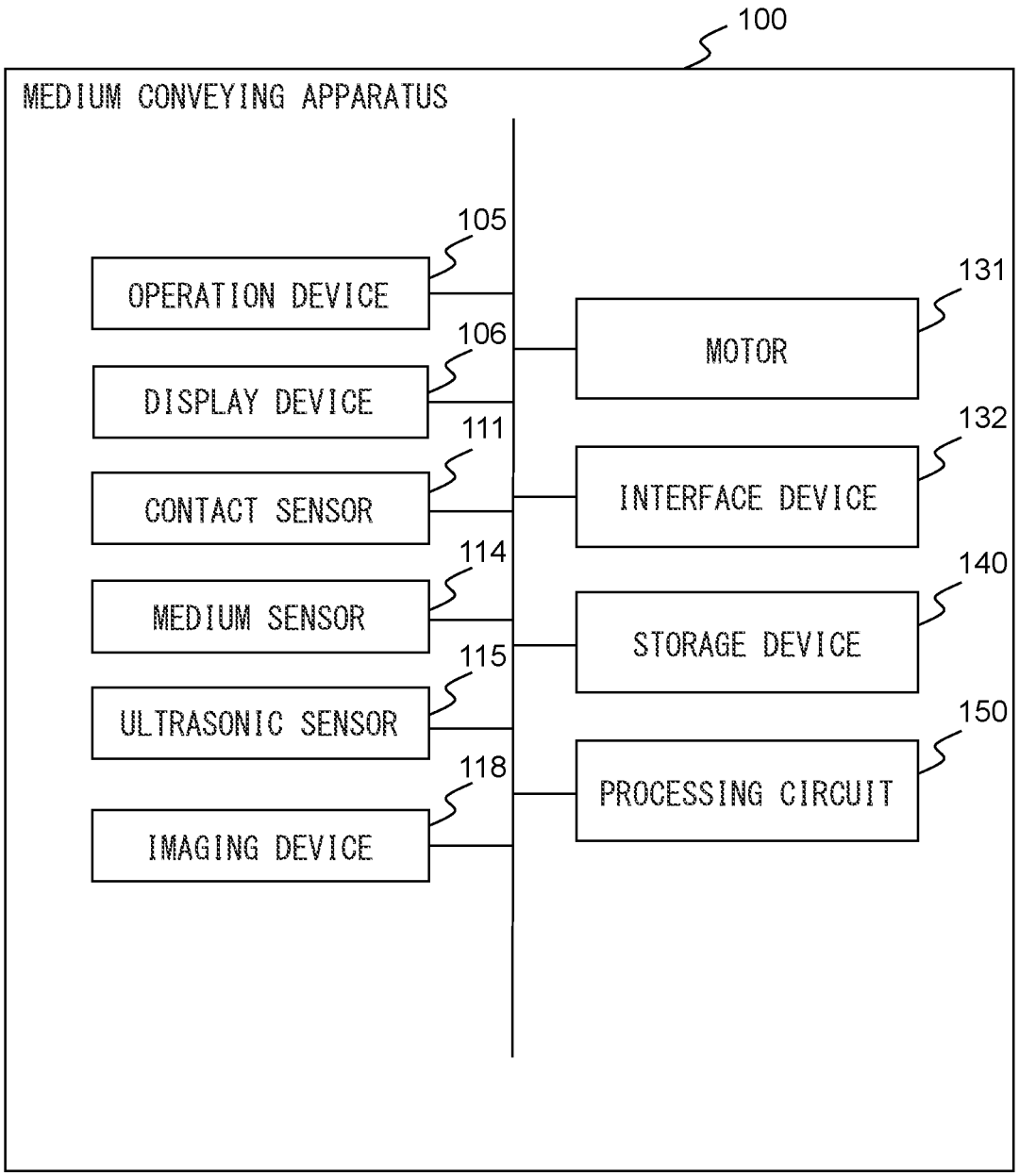
FIG. 4 is a block diagram illustrating a schematic configuration of the medium conveying apparatus 100.

FIG. 4 is a block diagram illustrating a schematic configuration of the medium conveying apparatus 100.

The medium conveying apparatus 100 further includes a motor 131, an interface device 132, a storage device 140, and a processing circuit 150, etc., in addition to the configuration described above.

The motor 131 includes one or more motors to rotate the feed roller 112, the brake roller 113, and the first to fourth conveyance rollers 116, 117, 119 and 120 to convey the medium by a control signal from the processing circuit 150.

For example, the interface device 132 includes an interface circuit conforming to a serial bus such as universal serial bus (USB), is electrically connected to an unillustrated information processing device, and transmits and receives a medium image generated based on the line image and various types of information. Further, a communication device including an antenna transmitting and receiving wireless signals, and a wireless communication interface device for transmitting and receiving signals through a wireless communication line in conformance with a predetermined communication protocol may be used in place of the interface device 132. For example, the predetermined communication protocol is a wireless local area network (LAN).

The storage device 140 includes a memory device such as a random access memory (RAM) or a read only memory (ROM), a fixed disk device such as a hard disk, or a portable storage device such as a flexible disk or an optical disk. Further, the storage device 140 stores a computer program, a database, a table, etc., used for various types of processing in the medium conveying apparatus 100. The computer program may be installed on the storage device 140 from a computer-readable, non-transitory medium such as a compact disc read only memory (CD-ROM), a digital versatile disc read only memory (DVD-ROM), etc., by using a well-known setup program, etc.

The storage device 140 stores dimensions and arrangement positions of the plurality of ultrasonic sensors 115 in the medium conveyance path and arrangement position of the imaging device 118, etc., as data.

The processing circuit 150 operates in accordance with a program previously stored in the storage device 140. The processing circuit 150 is, for example, a CPU (Central Processing Unit). The processing circuit 150 may be a digital signal processor (DSP), a large scale integration (LSI), an application specific integrated circuit (ASIC), a field-programmable gate array (FPGA), etc.

The processing circuit 150 is connected to the operating device 105, the display device 106, the contact sensor 111, the medium sensor 114, the ultrasonic sensor 115, the imaging device 118, the motor 131, the interface device 132 and the storage device 140, etc., and controls each of these units. The processing circuit 150 performs drive control of the motor 131, imaging control of the imaging device 118, etc., generates the medium image, and transmits the medium image to the information processing apparatus via the interface device 132. Further, the processing circuit 150 determines whether to execute an abnormality processing for a multi-feed, based on a width of the medium acquired based on a detection result by the imaging device 118 and a detection result by the ultrasonic sensor 115.

Figure 5:
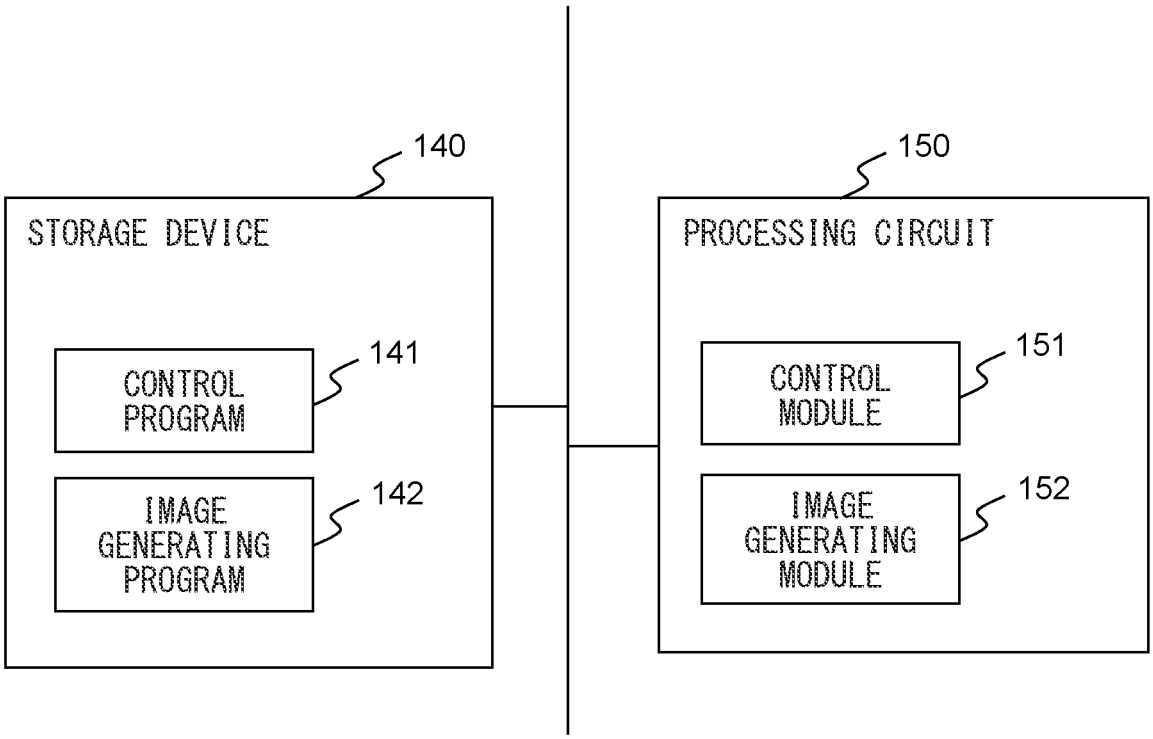
FIG. 5 is a diagram illustrating schematic configurations of the storage device 140 and the processing circuit 150.

FIG. 5 is a diagram illustrating schematic configurations of the storage device 140 and the processing circuit 150.

As shown in FIG. 5, the storage device 140 stores a control program 141, an image generating program 142, etc. Each of these programs is a functional module implemented by software operating on a processor. The processing circuit 150 reads each program stored in the storage device 140 and operates in accordance with each read program. Thus, the processing circuit 150 functions as a control module 151 and an image generating module 152.

Figure 6:
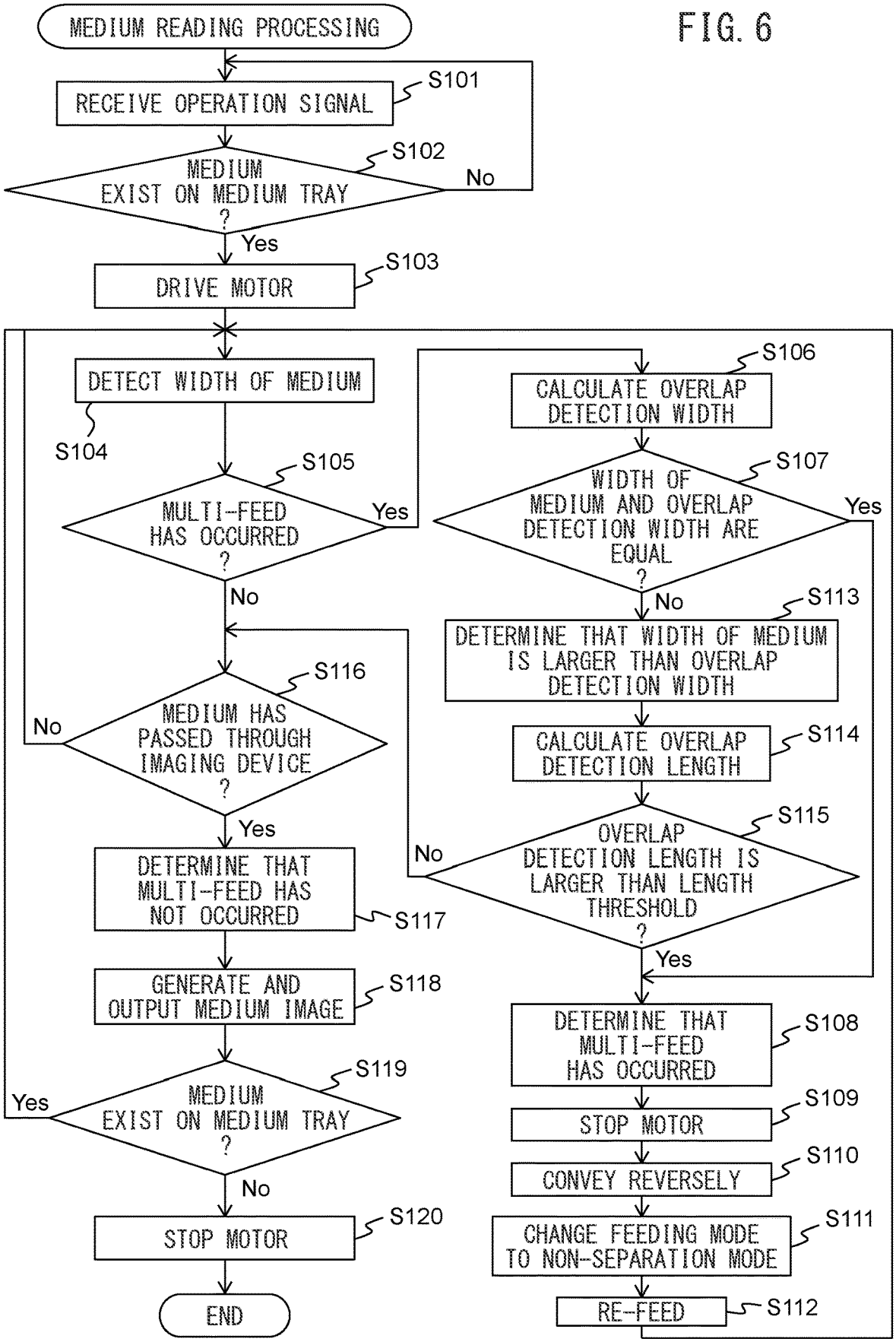
FIG. 6 is a flowchart illustrating an operation example of a medium reading processing.

FIG. 6 is a flowchart illustrating an operation example of medium reading processing in the medium conveying apparatus 100.

Referring to the flowchart illustrated in FIG. 6, an operation example of the medium reading processing in the medium conveying apparatus 100 will be described below. The operation flow described below is executed mainly by the processing circuit 150 in cooperation with each element in the medium conveying apparatus 100, in accordance with a program previously stored in the storage device 140. The operation flow illustrated in FIG. 6 is periodically executed. The medium conveying apparatus 100 has a separation mode for feeding by separating a plurality of media, and a non-separation mode for feeding without separating the medium, as a feeding mode for feeding the medium. The flow of operation shown in FIG. 6 is performed when the feeding mode is set to the separation mode.

First, the control module 151 stands by until an instruction to read a medium is input by a user by use of the operation device 105, and an operation signal instructing to read the medium is received from the operation device 105 (step S101).

Next, the control module 151 acquires the first medium signal from the contact sensor 111, and determines whether or not a medium is placed on the medium tray 103 based on the acquired first medium signal (step S102).

When a medium is not placed on the medium tray 103, the control module 151 returns the processing to step S101 and stands by until newly receiving an operation signal from the operation device 105.

On the other hand, when the medium is placed on the medium tray 103, the control module 151 drives the motor 131 and rotates the feeding roller 112, the brake roller 113, and the first to fourth conveyance rollers 116, 117, 119, and 120 to convey the medium (step S103). In the separation mode, the control module 151 drives the motor 131 to rotate the feed roller 112 and the first to fourth conveyance rollers 116, 117, 119 and 120 in the directions (the medium feeding direction or the medium conveying direction) of the arrows A4, A6, A7, A8 and A9, respectively. Further, the control module 151 drives the motor 131 to rotate the brake roller 113 in the direction of the arrow A5 (the direction opposite to the medium feeding direction).

Next, the control module 151 detects the width of the medium (step S104). The control module 151 acquires the line image from the imaging device 118, and identifies a position of an end of the medium, based on the acquired line image.

The control module 151 extracts an edge pixel from the line image. The control module 151 calculates an absolute value of the difference between gradation values of both of pixels adjacent to each pixel in a line image in a horizontal direction (hereinafter referred to as an adjacent difference value) and when the adjacent difference value exceeds a threshold value Thl, extracts the pixel as an edge pixel. The gradation value is a luminance value or an RGB value. For example, the threshold value Thl may be set to a difference in brightness value (for example, 20) according to which a person may determine a difference in brightness on an image by visual observation. The control module 151 detects the edge pixel located on the leftmost side as a left end edge pixel, and detects the edge pixel located on the rightmost side as a right end edge pixel, in the line image.

The control module 151 may calculate, for two adjacent pixels in the line image, average values of the gradation values of a plurality of pixels including each one pixel of the two adjacent pixels and adjacent to a side where the one pixel is located, and extract the edge pixel, based on an absolute value of a difference between the two average values of the gradation values. The control module 151 may calculate an absolute value of a difference between gradation values of two pixels apart from each pixel in a line image by a predetermined distance as the adjacent difference value. Further, the control module 151 may detect the edge pixel by comparing the gradation value of each pixel in the line image with the threshold value. For example, when the gradation value of a specific pixel is less than the threshold value and the gradation value of a pixel adjacent to the specific pixel or a pixel separated by a predetermined distance is equal to or larger than the threshold value, the control module 151 may detect the specific pixel as an edge pixel.

The control module 151 refers to the arrangement position of the imaging device 118 stored in the storage device 140, to specify positions on the medium conveyance path corresponding to the positions of the left edge pixel and the right edge pixel extracted in the line image, as the positions of the ends of the conveyed medium. The control module 151 detects a distance between the position of the left end edge pixel and the position of the right end edge pixel, as the width of the medium.

Figure 7A:
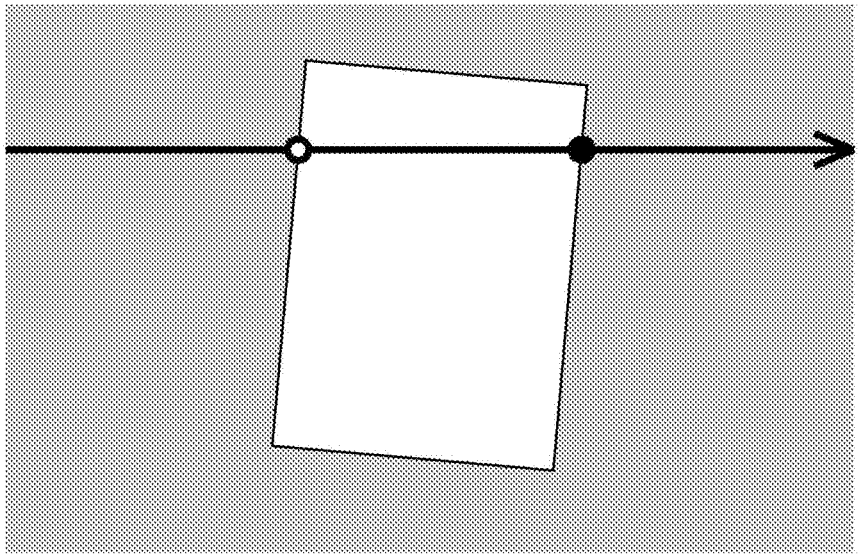
FIG. 7A illustrates an example of a medium image.
Figure 7B:
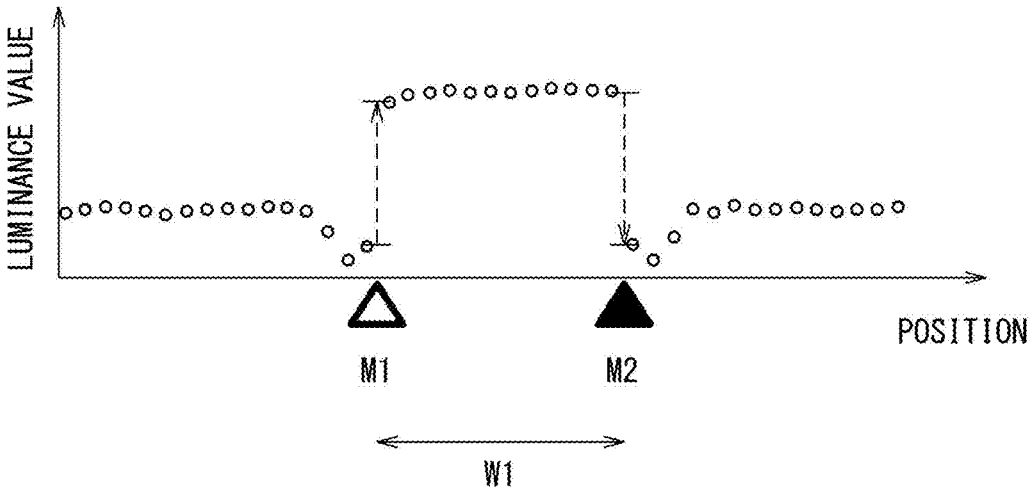
FIG. 7B is an example of a graph showing a luminance value of each pixel in a specific line image in the medium image.

FIG. 7A illustrates an example of the medium image. FIG. 7B is an example of a graph showing the luminance value of each pixel in a specific line image in the medium image.

The horizontal axis indicates positions of pixels in the line image, and the vertical axis indicates the luminance value of each pixel, in FIG. 7B. As shown in FIG. 7A and FIG. 7B, the luminance value changes at a boundary between a medium and a background in the line image. In the example shown in FIG. 7A and FIG. 7B, pixels corresponding to the left end position M1 and the right end position M2 of the medium are extracted as the left end edge pixel and the right end edge pixel.

Next, the control module 151 determines whether or not it has been determined in an overlap determination processing that an overlap of the medium has occurred (step S105). In the overlap determination processing, the control module 151 determines whether or not the overlap of the medium has occurred, for each ultrasonic sensor 115. Details of the overlap determination processing will be described later. When it has been determined in the overlap determination processing that the overlap of the medium has not occurred (step S105-No), the control module 151 proceeds the process to step S116.

On the other hand, when it has determined that the overlap of the medium has occurred in the overlap determination processing (step S105-Yes), the control module 151 calculates the overlap detection width (step S106). The overlap detection width is a width in which the medium is estimated to overlap in the direction A2 perpendicular to the conveying direction of the medium.

When the number of the ultrasonic sensor 115 for which it has been determined that the overlap of the medium has occurred in the overlap determination processing, i.e., the ultrasonic sensor 115 that has detected the overlap of the medium, is one, the control module 151 calculates the dimension of the ultrasonic receiver 115*b*as the overlap detection width. On the other hand, when the number of the ultrasonic sensors 115 that have detected the overlap of the medium is a plurality, the control module 151 specifies the ultrasonic sensors 115 located on the outermost side (closest to each side wall of the medium conveyance path) in the width direction A2 among from the ultrasonic sensors 115 that have detected the overlap of the medium. The control module 151 reads out the arrangement position of each of the specified ultrasonic sensors 115 from the storage device 140, and calculates a distance between the read arrangement positions as the overlap detection width. In this way, the control module 151 acquires the overlap detection width based on a detection result by the ultrasonic sensor 115. In particular, the control module 151 acquires the overlap detection width based on the detection result by the plurality of ultrasonic sensors 115 and the arrangement position of the plurality of ultrasonic sensors 115. Thus, the control module 151 can determine the overlap detection width with high accuracy.

FIG. 8A, FIG. 8B, FIG. 8C and FIG. 8D are schematic diagrams for illustrating the overlap detection width.

Figure 8A:
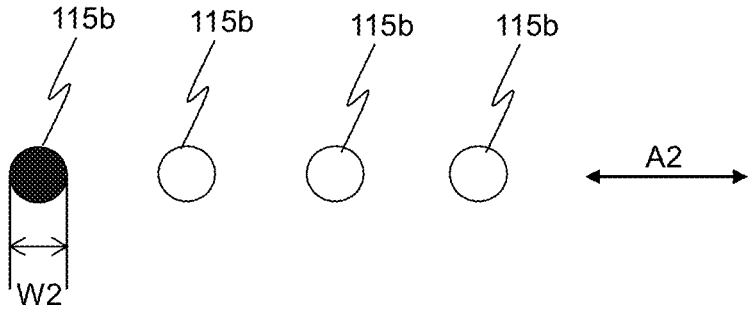
FIG. 8A is a diagram illustrating calculating an overlap detection width.

FIG. 8A shows an example in which the number of the ultrasonic sensor that has detected the overlap of the medium is one (the leftmost ultrasonic sensor 115). In this case, the dimension of the ultrasonic receiver 115*b*is calculated as the overlap detection width W2.

Figure 8B:
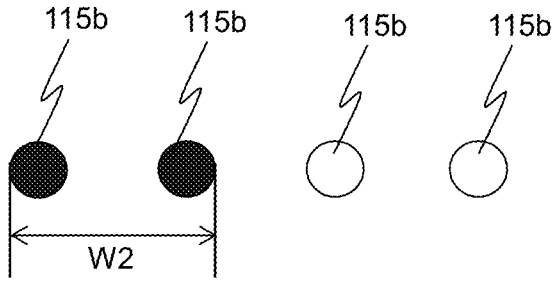
FIG. 8B is a diagram illustrating calculating the overlap detection width.

FIG. 8B shows an example in which the number of ultrasonic sensors that have detected the overlap of the medium is two (the leftmost ultrasonic sensor 115 and the second ultrasonic sensor 115 from the left). In this case, the distance between the leftmost ultrasonic sensor 115 and the second ultrasonic sensor 115 from the left, is calculated as the overlap detection width W2. The detection width W2 may include the dimensions of the ultrasonic receivers 115*b*at both ends.

Figure 8C:
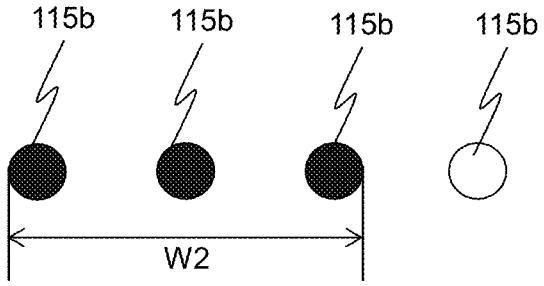
FIG. 8C is a diagram illustrating calculating the overlap detection width.

FIG. 8C shows an example in which the number of ultrasonic sensors that have detected the overlap of the medium is three (the leftmost ultrasonic sensor 115, the second ultrasonic sensor 115 from the left, and the third ultrasonic sensor 115 from the left). In this case, the distance between the leftmost ultrasonic sensor 115 and the third ultrasonic sensor 115 from the left, is calculated as the overlap detection width W2. The detection width W2 may include the dimensions of the ultrasonic receivers 115*b*at both ends.

Figure 8D:
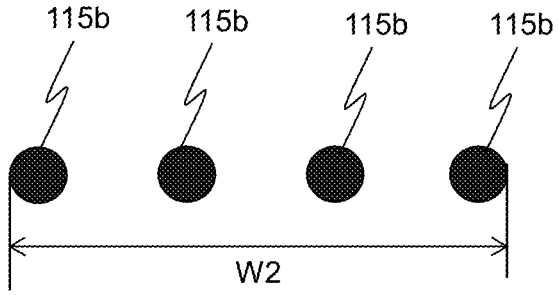
FIG. 8D is a diagram illustrating calculating the overlap detection width.

FIG. 8D shows an example in which the number of ultrasonic sensors that have detected the overlap of the medium is four. In this case, the distance between the leftmost ultrasonic sensor 115 and the rightmost ultrasonic sensor 115 is calculated as the overlap detection width W2. The detection width W2 may include the dimensions of the ultrasonic receivers 115*b*at both ends.

Next, the control module 151 determines whether or not the width of the medium detected in step S104, and the overlap detection width calculated in step S106 are equal (step S107). The width of the medium and the overlap detection width are equal, includes not only that the width of the medium and the overlap detection width are the same, but also that the difference between the width of the medium and the overlap detection width are equal to or less than a predetermined difference. The predetermined difference is the sum of a size of a transmission region through which the ultrasonic wave transmits the medium in the ultrasonic sensor 115 and the detection accuracy of the width of the medium, i.e., an interval of two ultrasonic sensors 115 adjacent to each other. The control module 151 determines whether or not the width of the medium and the overlap detection width are equal, in consideration of the detection accuracy of the width of the medium or/and the detection accuracy of the overlap detection width. For example, the control module 151 determines that the width of the medium and the overlap detection width are equal, when the width of the medium and the overlap detection width satisfies the following equation.

$$W2-\alpha \leq W1 \leq W2+\alpha \quad (1)$$

Where, W1 is the width of the medium, and W2 is the overlap detection width. α is a positive number, and is appropriately set based on the detection accuracy of the width of the medium and the detection accuracy of the overlap detection width. For example, α is set to the sum of the size of the transmission region through which the ultrasonic wave transmits the medium in the ultrasonic sensor 115 and the interval of the two ultrasonic sensors 115 adjacent to each other.

When the width of the medium and the overlap detection width are equal (step S107—Yes), the control module 151 determines that the multi-feed of the medium has occurred (step S108).

Next, the control module 151 stops the motor 131 to stop the feeding and the conveying of the medium as an abnormality processing for the multi-feed (step S109). The control module 151 can suppress damage to the medium, by stopping the feeding and the conveying of the medium when the multi-feed of the medium has occurred. Further, the control module 151 notifies the user of a warning by displaying information indicating that the multi-feed has occurred on the display device 106 or transmitting the information to the information processing device via the interface device 132, as the abnormality processing.

In this way, the control module 151 determines whether to execute the abnormality processing for the multi-feed, based on the width of the medium acquired based on the detection result by the imaging device 118 and the detection result by the ultrasonic sensor 115. In particular, the control module 151 executes the abnormality processing when the width of the medium and the overlap detection width are equal.

Next, the control module 151 drives the motor 131 to rotate the feed roller 112 and the first to fourth conveyance rollers 116, 117, 119 and 120 in the directions opposite to the arrows A4, A6, A7, A8 and A9 (the medium feeding direction or the medium conveying direction), respectively. Further, the control module 151 drives the motor 131 to rotate the brake roller 113 in the direction of the arrow A5 (the direction opposite to the medium feeding direction). Thus, the control module 151 conveys reversely the medium, and once returns the medium to the medium tray 103 (step S110).

Next, the control module 151 changes the feeding mode from the separation mode to the non-separation mode (step S111). In the non-separation mode, the control module 151 rotates the feed roller 112 and the first to fourth conveyance rollers 116, 117, 119 and 120 in the directions (the medium feeding direction or the medium conveying direction) of the arrows A4, A6, A7, A8 and A9, respectively. Further, in the non-separation mode, the control module 151 shuts off the driving force from the motor 131 to the brake roller 113 to turn off the separation function of the medium to be fed. The control module 151 may turn off the separation function of the medium to be fed by rotating the brake roller 113 in the medium feeding direction (the direction opposite to the arrow A5) or by reducing the separation force by the brake roller 113. In step S111, the control module 151 may control the driving force to the brake roller 113 to reduce the separation force or increase the separation force, instead of turning off the separation function.

Next, the control module 151 re-drives the motor 131 and re-rotates the feeding roller 112 and the first to fourth conveyance rollers 116, 117, 119 and 120 in the medium feeding direction or the medium conveying direction to re-feed and re-convey the medium (step S112). Next, the control module 151 proceeds the process to step S104. At this time, the brake roller 113 is driven by the feed roller 112 or rotates in the medium feeding direction by the motor 131 so as not to separate the medium.

In this way, after the control module 151 stops the feeding of the medium as the abnormality processing, the control module 151 controls the feed roller 112 and the brake roller 113 to once return the medium to the medium tray 103 and re-feed the medium without separating the medium. Consequently, a user does not need to re-feed the media by turning off the separation function of the medium, and the control module 151 can improve the convenience of the user. Incidentally, the processes of steps S113 and S115 are omitted, the control module 151 may only execute changing the feed mode while stopping feeding and conveying the medium. In that case, the user does not need to change the feeding mode, the control module 151 can improve the convenience of the user.

On the other hand, when the width of the medium and the overlap detection width are not equal (step S107—No), the control module 151 determines that the width of the medium is larger than the overlap detection width (step S113).

Next, the control module 151 calculates the overlap detection length, based on the detection result by the ultrasonic sensor 115 (step S114). The overlap detection length is a length in which the medium is estimated to overlap along the conveying direction A1 of the medium.

The control module 151 calculates a period in which the ultrasonic signal output from each ultrasonic sensor 115 indicated continuously a value less than an overlap threshold to be described later so far, for each ultrasonic sensor 115 that has detected the overlap of the medium in the overlap determination processing. The control module 151 calculates a multiplied value acquired by multiplying the calculated period by a feed amount of the medium per unit time by the feed roller 112. The control module 151 selects the maximum value of the calculated value for each ultrasonic sensor 115 as the overlap detection length. In this way, the control module 151 acquires the overlap detection length based on the detection result by the ultrasonic sensor 115. In particular, the control module 151 acquires the overlap detection length, based on the detection result by at least one of the plurality of ultrasonic sensors 115. Thus, the control module 151 can acquire the overlap detection length with high accuracy.

Next, the control module 151 determines whether or not the overlap detection length is equal to or more than the length threshold (step S115). The length threshold is set to, for example, a value acquired by adding a margin to a size of an adhered object such as a photograph adhered to a general history sheet or a postage stamp.

When the overlap detection length is equal to or more than the length threshold (step S115-Yes), the control module 151 determines that a conveyance abnormality of the medium has occurred (step S108). Next, the control module 151, as in the case where the width of the medium and the overlap detection width are equal, executes the abnormality processing for the multi-feed (steps S109 to S112), and proceeds the process to step S104.

On the other hand, when the overlap detection length is less than the length threshold (step S115-No), the control module 151 determines whether or not the entire medium has passed through an imaging position of the imaging device 118 (step S116). The control module 151, for example, determines whether or not the rear end of the medium has passed through the position of the medium sensor 114 based on the second medium signal received from the medium sensor 114. The control module 151 periodically acquires the second medium signal from the medium sensor 114, and determines that the rear end of the medium has passed through the position of the medium sensor 114 when the signal value of the second medium signal changes from a value indicating that the medium is present to a value indicating that there is no medium. The control module 151 determines that the rear end of the medium has passed through the imaging position of the imaging device 118 and the entire medium has been imaged when a predetermined time has elapsed since the rear end of the medium passes through the position of the medium sensor 114. The control module 151 may determine the entire conveyed medium has been imaged when a predetermined time has elapsed since the start of feeding of the medium. When the entire medium has not yet passed through the imaging position, the control module 151 returns the process to step S104.

On the other hand, when the entire medium has passed through the imaging position, the control module 151 determines that the multi-feed of the medium has not occurred (step S117).

In other words, the control module 151 does not execute the abnormality processing for the multi-feed when the width of the medium is more than the overlap detection width and the overlap detection length is less than the length threshold. Thus, the control module 151 can suppress to stop the feeding of the medium by erroneously determining that the multi-feed has occurred when the medium on which the adhered object is adhered is conveyed. Therefore, the medium conveying apparatus 100 can suppress the user from resetting and re-feeding the medium, and thereby improve the convenience of the user. On the other hand, the control module 151 can determine that the multi-feed has occurred, and appropriately execute the abnormality processing when the small medium and the large medium are conveyed in an overlapped state.

In steps S114 to S115, the control module 151 may determine whether or not the signal value of the ultrasonic signal is equal to or more than the second overlap threshold, in place of or in addition to determining whether or not the overlap detection length is equal to or more than the length threshold. The second overlap threshold is set to a value less than the overlap threshold. In particular, the second overlap threshold is set to a value between the signal value of the ultrasonic signal when two media overlap without being adhered and the signal value of the ultrasonic signal when the adhered object is adhered to the medium. There is no air layer between the medium and the adhered object when the adhered object is adhered to the medium. Thus, the amount of attenuation of the ultrasonic wave is reduced as compared with the case where two media overlap without being adhered. When the width of the medium is more than the overlap detection width and the signal value of the ultrasonic signal is equal to or more than the second overlap threshold, the control module 151 determines that the medium to which the adhered object is adhered has been conveyed and does not execute the abnormality processing by the multi-feed. Thus, the control module 151 can accurately determine whether the medium to which the adhered object is adhered has been conveyed, or the small medium and the large medium have been conveyed in an overlapped state.

The processes of step S114 to S115 are omitted, and the control module 151 may determine that the multi-feed of the medium has not occur, and may not execute the abnormality processing for the multi-feed when the width of the medium is larger than the overlap detection width. Thus, the control module 151 can suppress to stop the feeding of the medium by erroneously determining that the multi-feed has occurred when the medium on which the adhered object is adhered is conveyed. The control module 151 may receive the setting of whether to execute the processes of steps S114 to S115 from the user using the operation device 105. The user can set to omit the processes of steps S114 to S115 when it is unlikely that the media of which the sizes are different are mixed. Thus, the control module 151 can suppress to stop the feeding of the medium by erroneously determining that the multi-feed has occurred when the medium on which the adhered object is adhered is conveyed, while reducing the processing load of the medium reading processing.

Next, the image generating module 152 acquires each line image generated during conveying the medium from the imaging device 118, synthesizes all the acquired line images to generate the medium image, and transmits it to the information processing apparatus via the interface device 132 (step S118).

Next, the control module 151 determines whether or not the medium remains on the medium tray 103 based on the first medium signal acquired from the contact sensor 111 (step S119). When a medium remains on the medium tray 103, the control module 151 returns the process to step S104 and repeats the processes in steps S104 to S119.

On the other hand, when a medium does not remain on the medium tray 103, the control module 151 stops the motor 131 to stop conveying the medium (step S120), and ends the series of steps.

The processes of step S110 to S112 are omitted, the control module 151 may end the series of steps without executing the re-feeding of the medium when the control module 151 stops the feeding and the conveying of the medium.

Figure 9:
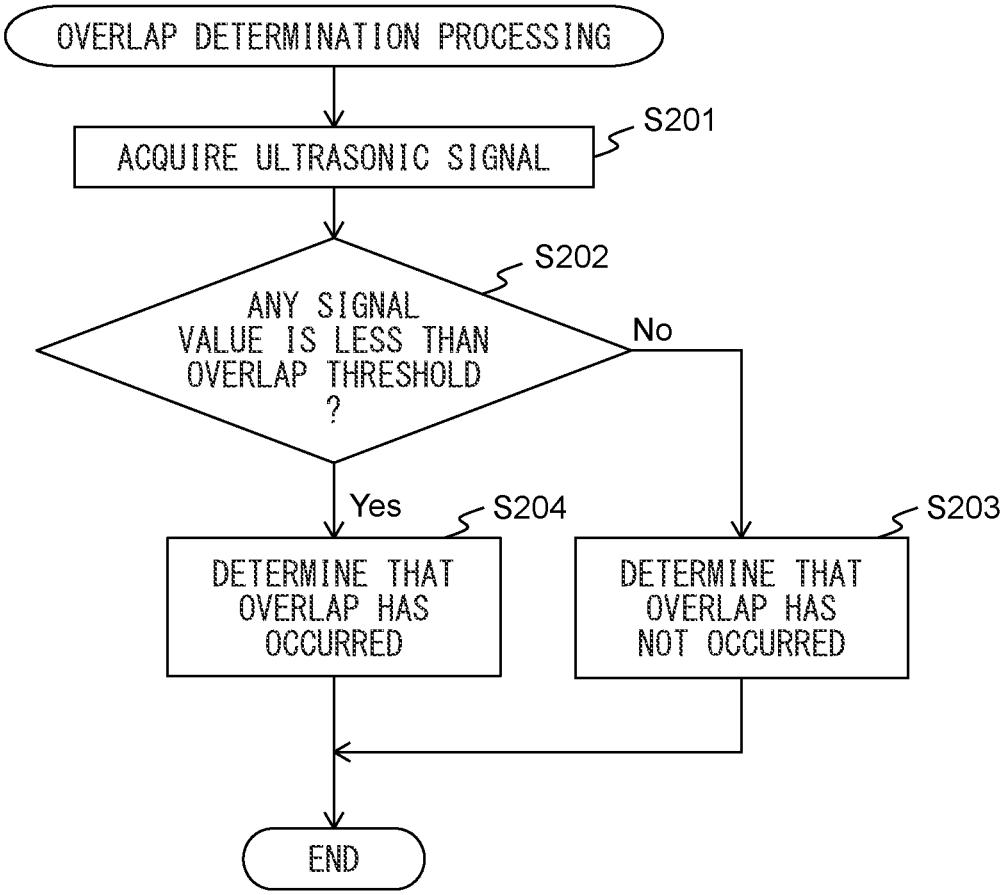
FIG. 9 is a flowchart illustrating an operation example of an overlap determination processing.

FIG. 9 is a flowchart illustrating an operation example of the overlap determination processing.

Referring to the flowchart illustrated in FIG. 6, an operation example of the overlap determination processing in the medium conveying apparatus 100 will be described below. The operation flow described below is executed mainly by the processing circuit 150 in cooperation with each element in the medium conveying apparatus 100, in accordance with a program previously stored in the storage device 140. The flow of the operation illustrated in FIG. 9 is periodically executed during medium conveyance.

First, the control module 151 acquires the ultrasonic signal from each ultrasonic sensor 115 (step S201).

Next, the control module 151 determines whether or not the signal value of each acquired ultrasonic signal is less than the overlap threshold (step S202). The overlap threshold is set to a value between the signal value of the ultrasonic signal when a single medium is conveyed and the signal value of the ultrasonic signal when the overlap of the medium has occurred.

When the signal values of all the ultrasonic signals are equal to or more than the overlap threshold, the control module 151 determines that the overlap of the medium has not occurred (step S203), and ends the series of steps. On the other hand, when the signal value of any of the ultrasonic signals is less than the overlap threshold, the control module 151 determines that the overlap of the medium has occurred (step S204), and ends the series of steps.

In this way, the control module 151 determines whether or not the overlap of the medium has occurred based on the ultrasonic signal.

Figure 10A:
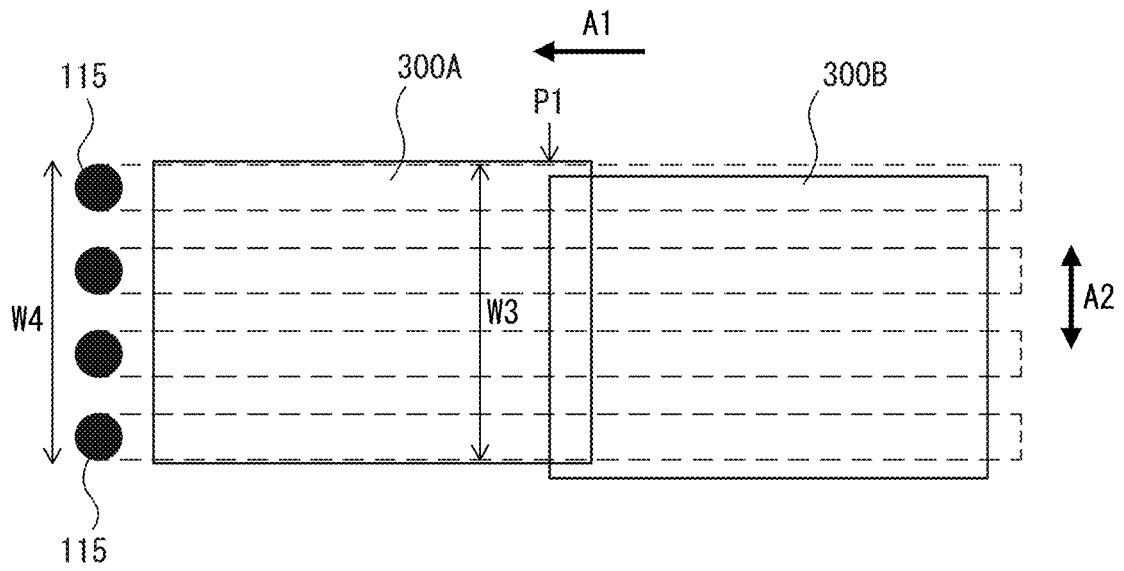
FIG. 10A is a schematic diagram for illustrating a technical significance of determining whether or not a multi-feed of a medium has occurred based on the overlap detection width.
Figure 10B:
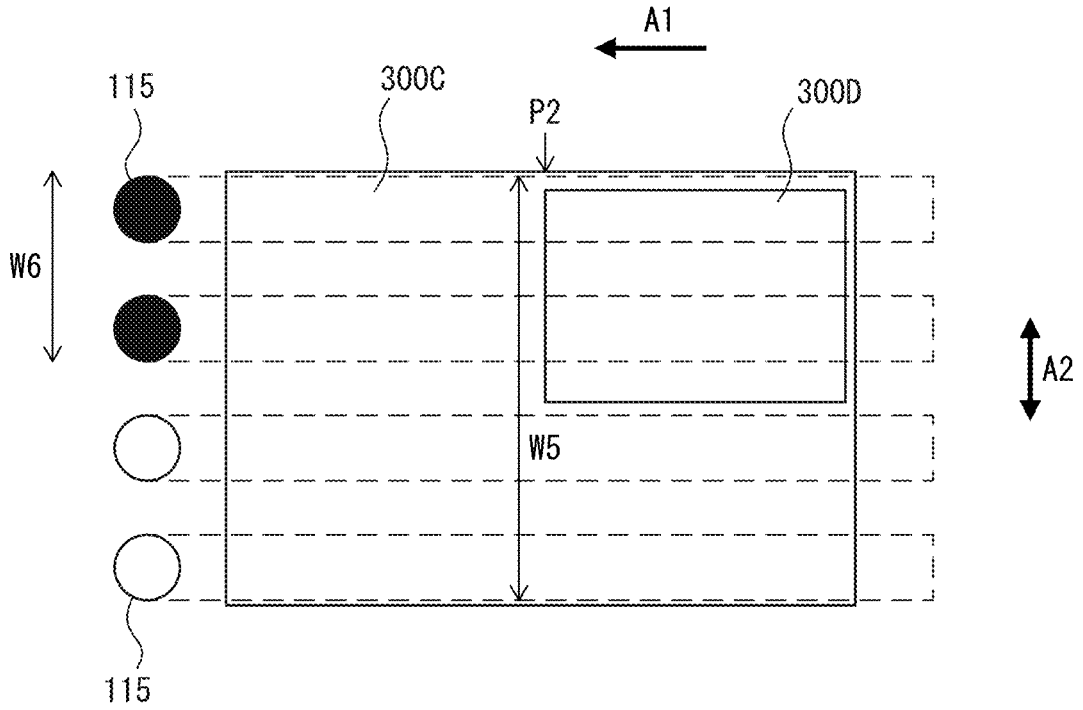
FIG. 10B is a schematic diagram for illustrating a technical significance of determining whether or not a multi-feed of a medium has occurred based on the overlap detection width.

FIG. 10A and FIG. 10B are schematic diagrams for illustrating a technical significance of determining whether or not the multi-feed of the medium has occurred based on the overlap detection width.

In an example shown in FIG. 10A, a medium 300A and a medium 300B having a width W3 substantially equal to a distance W4 between the ultrasonic sensors 115 located at both ends are conveyed, the rear end of the medium 300A and the front end of the medium 300B has overlapped.

In this case, the overlap of the medium is detected by all of the ultrasonic sensors 115, the distance W4 between the ultrasonic sensors 115 located at both ends as the overlap detection width is calculated. Since the distance W4 between the ultrasonic sensors 115 located at both ends and the width W3 of the medium 300A are substantially equal, it is determined that the multi-feed of the medium has occurred.

After the front ends of the media are well separated by the feed roller 112 and the brake roller 113, a frictional force between a fed medium and a medium in contact with the fed medium may become larger than a separation force by the feed roller 112 and the brake roller 113, and thereby, the multi-feed may occur. In that case, as shown in FIG. 10A, the medium 300B in contact with the medium 300A at the rear end side of the medium 300A may be conveyed in an overlapped manner without the occurrence of the multi-feed at the front end side of the fed medium 300A. Since the length in which the medium 300A and the medium 300B overlap in the medium conveying direction A1 may be the same as the adhered object, it is difficult to determine whether the medium to which the adhered object is adhered has been conveyed or the multi-feed of the medium has occurred based on only the overlap detection length. The medium conveying apparatus 100 determines whether or not the multi-feed of the medium has occurred based on the overlap detection width in the width direction A2, so that it can accurately determine whether the medium to which the adhered object is adhered has been conveyed or the multi-feed of the medium has occurred.

Further, when the width of the medium and the overlap detection width are equal, the medium conveying apparatus 100 determines that the multi-feed of the medium has occurred without determining the overlap detection length in the medium conveying direction A1, Therefore, when the multi-feed of the medium has occurred, the medium conveying apparatus 100 can immediately execute the abnormality processing.

In an example shown in FIG. 10B, a medium 300C having a width W5 substantially equal to the distance between the ultrasonic sensors 115 located at both ends, to which an adhered object 300D having a width substantially equal to a distance W6 between two ultrasonic sensors 115 adjacent to each other is adhered, has been conveyed.

In this case, the overlap of the medium is detected only by the two ultrasonic sensors 115 facing the adhered object 300D, the distance W6 between the two ultrasonic sensors 115 is calculated as the overlap detection width. Since the width W5 of the medium 300C is more than the calculated distance W6 and the length in which the media overlap along the medium conveying direction A1 is less than the length threshold, it is determined that the multi-feed of the medium has not occurred. In this way, the medium conveying apparatus 100 can appropriately detect the occurrence of the multi-feed of the medium while suppressing erroneously determining that the multi-feed of the medium has occurred when the medium to which the adhered object is adhered has been conveyed. In addition, when the length in which the media overlap along the medium conveying direction A1 is equal to or more than the length threshold, it is determined that the multi-feed of the media has occurred. Therefore, the medium conveying apparatus 100 can appropriately detect the occurrence of the multi-feed of the medium when the media having different sizes has been conveyed in an overlapped state.

As described in detail above, the medium conveying apparatus 100 executes the abnormality processing for the multi-feed if the overlap detection width and the width of the medium coincide when the overlap of the medium has occurred. Thus, the medium conveying apparatus 100 can prevent erroneous determination of the multi-feed, and more accurately determine whether or not the multi-feed of the medium has occurred.

In the above-described embodiment, although the abnormality processing has been performed after detecting the position of the end portion of the medium, the abnormality processing may be executed after generating the medium image acquired by synthesizing the line image generated by the imaging device 118. In this case, the processes of steps S104 to S115 are performed after the medium image is generated in step S118. Further, the control module 151 periodically acquires the ultrasonic signal and stores the signal value of the ultrasonic signal in the storage device 140 for each position in the medium conveying direction A1 in the medium. When the medium image is generated, the control module 151 acquires the width of the medium for each line in the horizontal direction in the medium image and determines whether or not the overlap of the medium has occurred. When the overlap has occurred, the control module 151 acquires the overlap detection width, and determines that the multi-feed of the medium has occurred when the overlap detection width and the width of the medium coincide. On the other hand, when the overlap detection width and the width of the medium do not coincide, the control module 151 determines whether or not the overlap detection length is equal to or more than the length threshold, and determines that the multi-feed of the medium has occurred when the overlap detection length is equal to or more than the length threshold.

Further, in the above-described embodiment, although the ultrasonic sensor to output the transmission information of the ultrasonic wave is used as the overlap detection sensor, the thickness sensor to detect thickness information of the medium may be used as the overlap detection sensor. The thickness sensor is located at a position where each ultrasonic sensor 115 is located. The thickness sensor includes a light emitter and a light receiver located close to the conveyance path of the medium in such a way as to face one another with the conveyance path in between. The light emitter emits light (infrared light or visible light) toward the light receiver. On the other hand, the light receiver receives the light emitted by the light emitter, and generates and outputs a thickness signal being an electric signal corresponding to the intensity of the received light. When a medium exists at the position of the thickness sensor, the light emitted by the light emitter is attenuated by the medium, and the greater the thickness of the medium, the greater the amount of attenuation. For example, the thickness sensor generates the thickness signal such that the greater the thickness of the medium, the greater the signal value.

A reflected light sensor, a pressure sensor or a mechanical sensor may be used as the thickness sensor. The reflected light sensor includes a pair of light emitter and light receiver provided on one side with respect to a conveyance path of the medium and a pair of light emitter and light receiver provided on the other side. The reflected light sensor detects a distance between each pair and each surface of the medium, based on a time from when one pair emits light to one surface of the medium to when it receives the reflected light and a time from when the other pair emits light to the other surface of the medium to when it receives the reflected light. The reflected light sensor generates a thickness signal which indicates a subtracted value acquired by subtracting each detected distance from a distance between the two pairs, as the thickness information. The pressure sensor detects a pressure which changes according to the thickness of the medium, and generates a thickness signal which indicates the detected pressure, as the thickness information. The mechanical sensor detects a movement amount of a roller in contact with the medium, and generates a thickness signal which indicates the detected movement amount, as the thickness information.

When the thickness sensor is used as the overlap detection sensor, in the overlap determination processing, the control module 151 acquires the thickness signal from the thickness sensor instead of the ultrasonic signal, and determines whether or not the overlap of the medium has occurred depending on whether or not the signal value of the acquired thickness signal is equal to or more than the overlap threshold. Further, in step S106 of FIG. 6, the control module 151 acquires the overlap detection width based on the detection result by the thickness sensor that detects the overlap. Furthermore, in step S114, the control module 151 acquires the overlap detection length based on a period in which the thickness signal indicates continuously a value equal to or more than the overlap threshold.

Further, in the above-described embodiment, although the feed roller 112 is located on the lower side of the brake roller 113 and feeds the medium placed on the medium tray 103 sequentially from the lower side, the feed roller may be located on the upper side of the brake roller so as to feed the medium placed on the medium tray sequentially from the upper side.

Although, in the above-described embodiment, the imaging device is used as the width detection sensor, the width detection sensor is not limited thereto.

Figure 11:
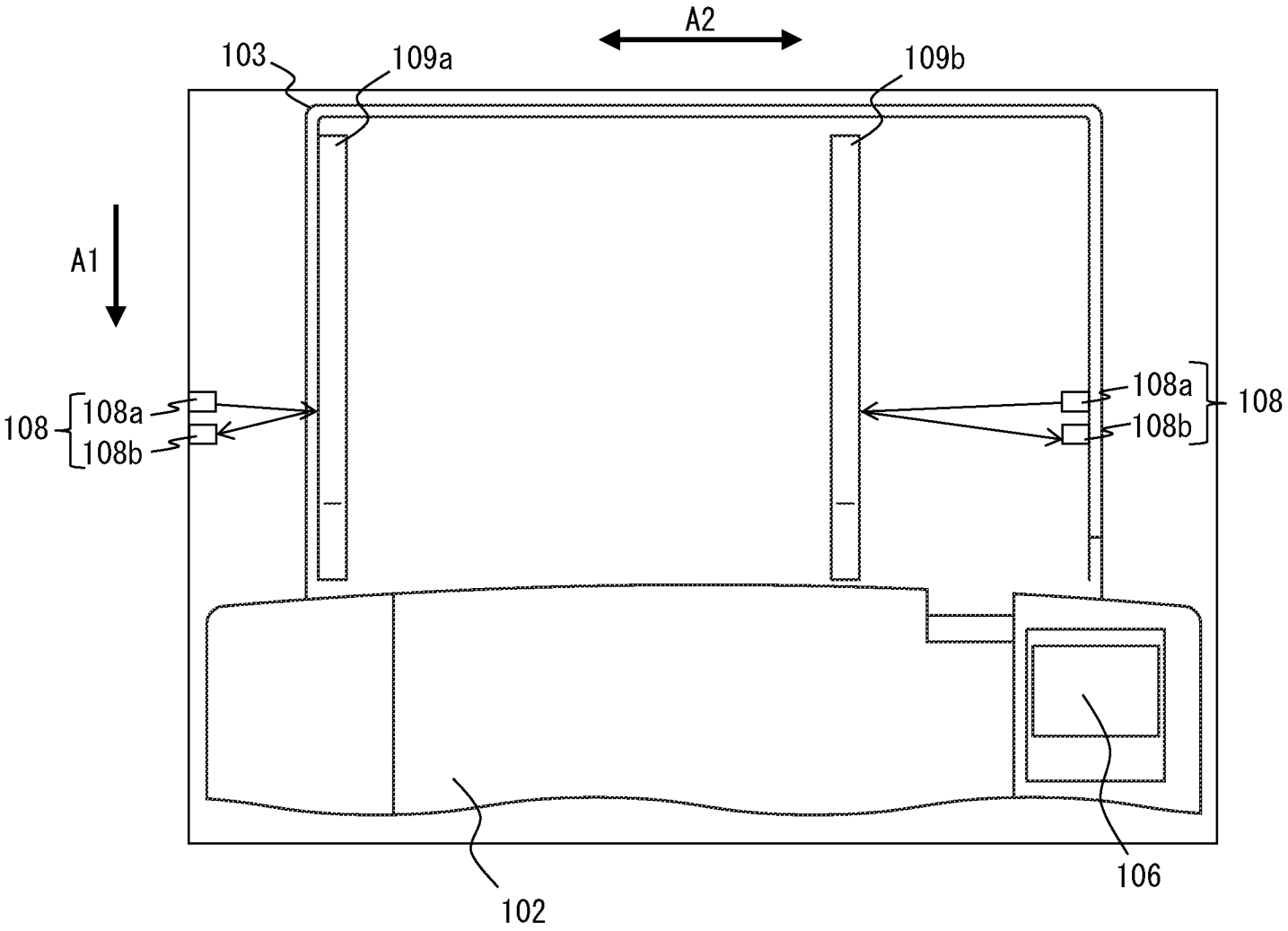
FIG. 11 is a schematic diagram for illustrating other means to detect a width of the medium.

FIG. 11 is a schematic diagram for illustrating other means to detect the width of the medium.

In an example shown in FIG. 11, the width detecting sensor includes a distance measuring sensor 108 to detect arrangement positions of the first side guide 109*a* and the second side guide 109*b* to regulate a position of the medium in the width direction, and the control module 151 specifies the position of the end portion of the medium based on a detection result of the distance measuring sensor 108. Although detecting the arrangement position of the second side guide 109*b* using the distance measuring sensor 108 will be described below, this description is also appropriately applied to detecting the arrangement position of the first side guide 109*a* using the distance measuring sensor 108.

The distance measuring sensor 108 is located so as to overlap the second side guide 109*b* in the medium conveying direction A1, i.e., when viewed from the width direction A2, and at a predetermined position on the end side of the conveyance path in the width direction A2, to measure a distance from the located predetermined position to the second side guide 109*b*. The distance measuring sensor 108 measures a distance from an object existing at a facing position, based on a time difference from when it emits infrared rays to when it receives reflected infrared rays. The distance measuring sensor 108 includes a light emitter 108*a* and a light receiver 108*b*. The light emitter 108*a* emits infrared light toward the center side in the width direction A2, i.e., toward the second side guide 109*b*. On the other hand, the light receiver 108*b* receives the light emitted by the light emitter 108*a* and reflected by the second side guide 109*b*, and generates and outputs a detection signal being an electric signal corresponding to the time from when the light emitter 108*a* emits the light to when the light receiver 108*b* receives the light. In other words, the detection signal is a signal corresponding to the distance from the predetermined position at which the distance measuring sensor 108 is located to the second side guide 109*b*. The control module 151 acquires the distance between the distance measuring sensor 108 and the second side guide 109*b*, based on a position at which the distance measuring sensor 108 is located and the detection signal. Then, the control module 151 identifies the position of the end of the medium on the side of the second side guide 109*b*, based on the position at which the distance measuring sensor 108 is located, the distance between the distance measuring sensor 108 and the second side guide 109*b*, and a thickness of the second side guide 109*b*. Similarly, the distance measuring sensor 108 specifies the position of the end portion of the medium on the side of the first side guide 109*a*.

The control module 151 acquires the width of the medium based on the position of the end portion of the medium on the side of the first side guide 109*a* and the position of the end portion of the medium on the side of the second side guide 109*b*.

The distance measuring sensor 108 may include a transmitter to transmit an ultrasonic wave and a receiver to receive the ultrasonic wave, instead of the light emitter 108*a* and the light receiver 108*b*, and measure the distance to the second side guide 109*b* based on the time difference from when it transmits the ultrasonic wave to when it receives the reflected ultrasonic wave. In that case, the distance measuring sensor 108 generates an electrical signal corresponding to the time from when the transmitter transmits the ultrasonic wave to when the receiver receives the ultrasonic wave, as a detection signal. Alternatively, the distance measuring sensor 108 may include a transmitter to transmit audible sounds and a receiver to receive an audible sound, and measure the distance to the second side guide 109*b* based on the time difference from when it transmits the audible sound to when it receives the reflected audible sounds. In that case, the distance measuring sensor 108 generates an electrical signal corresponding to the time from when the transmitter transmits the audible sound until the receiver receives the audible sound, as a detection signal.

Further, a conductor such as metal may be attached to the second side guide 109*b*, and an inductive proximity sensor including a coil, to detect a magnetic loss due to eddy currents generated on the conductor surface, may be used as the distance measuring sensor 108. In that case, the measuring sensor 108 generates an electrical signal corresponding to a magnitude of an impedance in the coil as a detection signal. Alternatively, a metal or a dielectric may be attached to the second side guide 109*b*, and a capacitive proximity sensor to detect a change in capacitance between the second side guide 109*b* and the distance measuring sensor 108, may be used as the distance measuring sensor 108. In that case, the distance measuring sensor 108 generates an electrical signal corresponding to the magnitude of the capacitance between the second side guide 109*b* and the distance measuring sensor 108 as a detection signal.

Further, a magnet may be attached to the second side guide 109*b*, and a magnetic sensor to detect a magnitude of the ground field (magnetic field) between the second side guide 109b and the distance measuring sensor 108, may be used, as the distance measuring sensor 108. In that case, the distance measuring sensor 108 generates an electrical signal corresponding to the magnitude of the magnetic field between the second side guide 109*b* and the distance measuring sensor 108 as a detection signal.

Further, a sensor including an optical rotary encoder, to detect an amount of a movement from an initial position of the second side guide 109*b* (predetermined position), may be used as the distance measuring sensor 108. The rotary encoder includes a disk in which a number of slits are formed and provided to rotate according to a movement of the second side guide 109*b*, and a light emitter and a light receiver provided to face each other with the disc in between. In that case, the distance measuring sensor 108 generates an electrical signal corresponding to the number of changes between a state in which the slit exists between the light emitter and the light receiver and a state in which the slit does not exist and the light emitter and the light receiver are blocked by the disk as a detection signal.

Further, a sensor including an optical linear encoder, to detect an amount of a movement from the initial position of the second side guide 109*b* (predetermined position), may be used as the distance measuring sensor 108. The optical linear encoder includes a glass scale on which a grating scale is formed, and a light emitter and a light receiver provided to face each other with the glass scale in between, and move according to the movement of the second side guide 109*b*. In that case, the distance measuring sensor 108 generates an electrical signal corresponding to the number of times of change in the light amount in the light receiver as a detection signal.

Further, a sensor including a magnetic linear encoder, to detect the amount of the movement from the initial position of the second side guide 109*b* (predetermined position), may be used as the distance measuring sensor 108. The magnetic linear encoder includes a magnetic scale on which a predetermined magnetic pattern is formed, and a magnetic detection head provided to face the magnetic scale, and move according to the movement of the second side guide 109*b*. In that case, the distance measuring sensor 108 generates an electrical signal corresponding to the number of change in the magnetism detected by the magnetic detection head, as a detection signal.

Further, a sensor including a sliding resistor, to detect a voltage by the sliding resistor may be used as the distance measuring sensor 108. The sliding resistor includes a resistor extending in the width direction A2 to which a constant voltage is applied from terminals at both ends, and a contact (slider) provided to move according to the movement of the second side guide 109*b* while in contact with the resistor. In that case, the second side guide 109*b* generates an electrical signal corresponding to the magnitude of the voltage applied from one end of the resistor to the slider as a detection signal.

Figure 12:
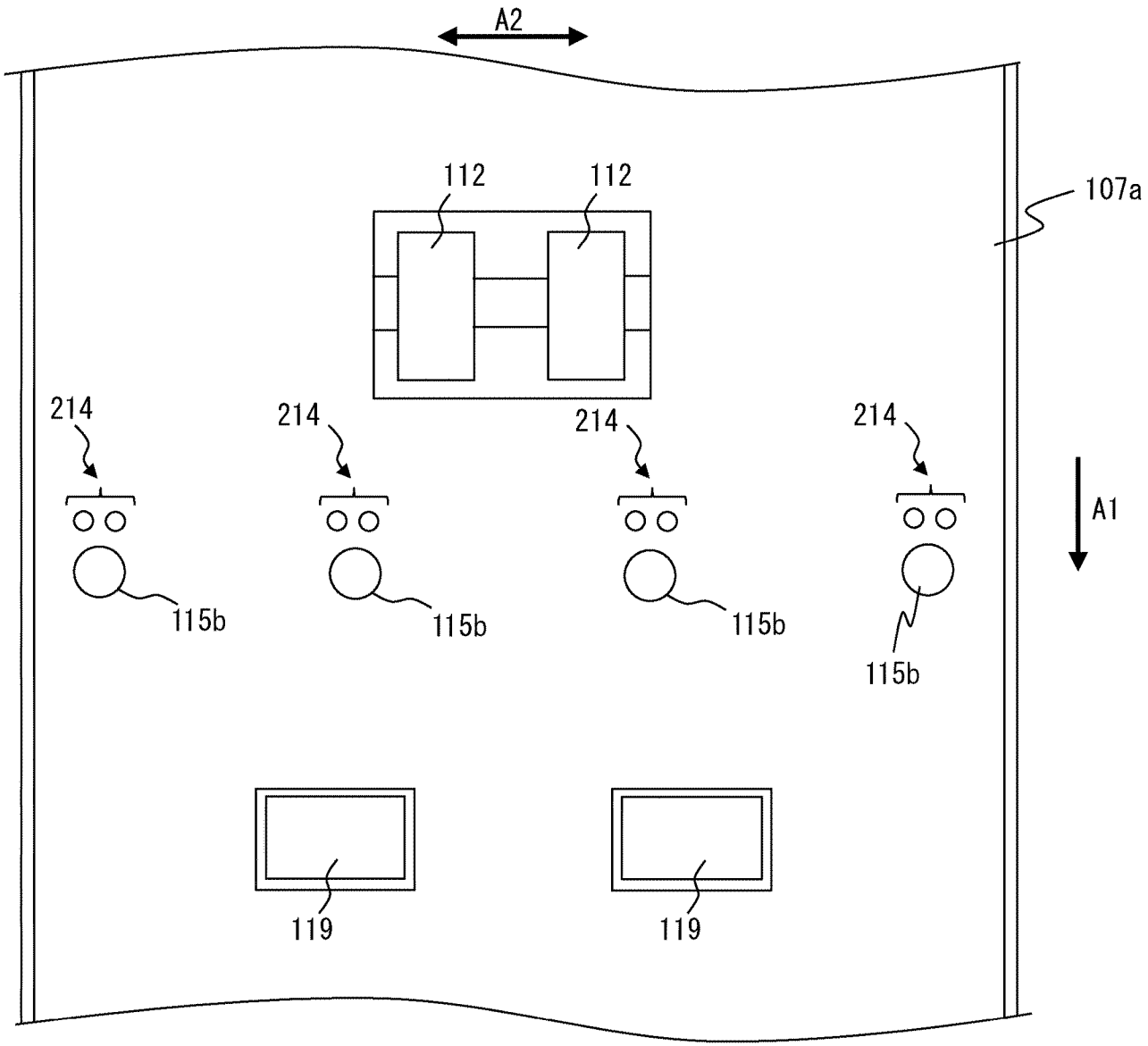
FIG. 12 is a schematic diagram for illustrating yet another means to detect the width of the medium.

FIG. 12 is a schematic diagram for illustrating a yet another means to detect the width of the medium.

In the example shown in FIG. 12, the width detecting sensor includes a plurality of medium sensors 214, the control module 151 acquires the width of the medium based on the detection result of the plurality of medium sensors 214.

Each medium sensor 214 has the same configuration as the medium sensor 114. Each medium sensor 214 is located apart from each other along in the width direction A2. In particular, each medium sensor 214 is located so as to overlap with each ultrasonic sensor 115 in the width direction A2, i.e., so as to overlap with each ultrasonic sensor 115 when viewed from the medium conveying direction A1, The control module 151 calculates a distance between the medium sensor 214 located on the outermost (closest to each side wall of the medium conveyance path) in the width direction A2, among from the medium sensor 214 that have detected the medium, as the width of the medium.

Further, a number of medium sensors 114 may be located along in the width direction perpendicular to the medium conveying direction, and the medium conveying apparatus 100 may calculate the width of the medium.

The control module 151 may calculate the width of the medium based on the ultrasonic signal from the ultrasonic sensor 115. In that case, the control module 151 determines that the medium exists at a position facing the ultrasonic sensor 115 of which the signal value of the ultrasonic signal is less than the medium threshold. The medium threshold is set to a value between the signal value of the ultrasonic signal when the medium does not exist and the signal value of the ultrasonic signal when a single medium is conveyed. The control module 151 calculates the distance between the ultrasonic sensors 115 located on the outermost side (closest to each side wall of the medium conveyance path) in the width direction A2, among from the ultrasonic sensors 115 that have detected the medium, as the width of the medium.

Figure 13:
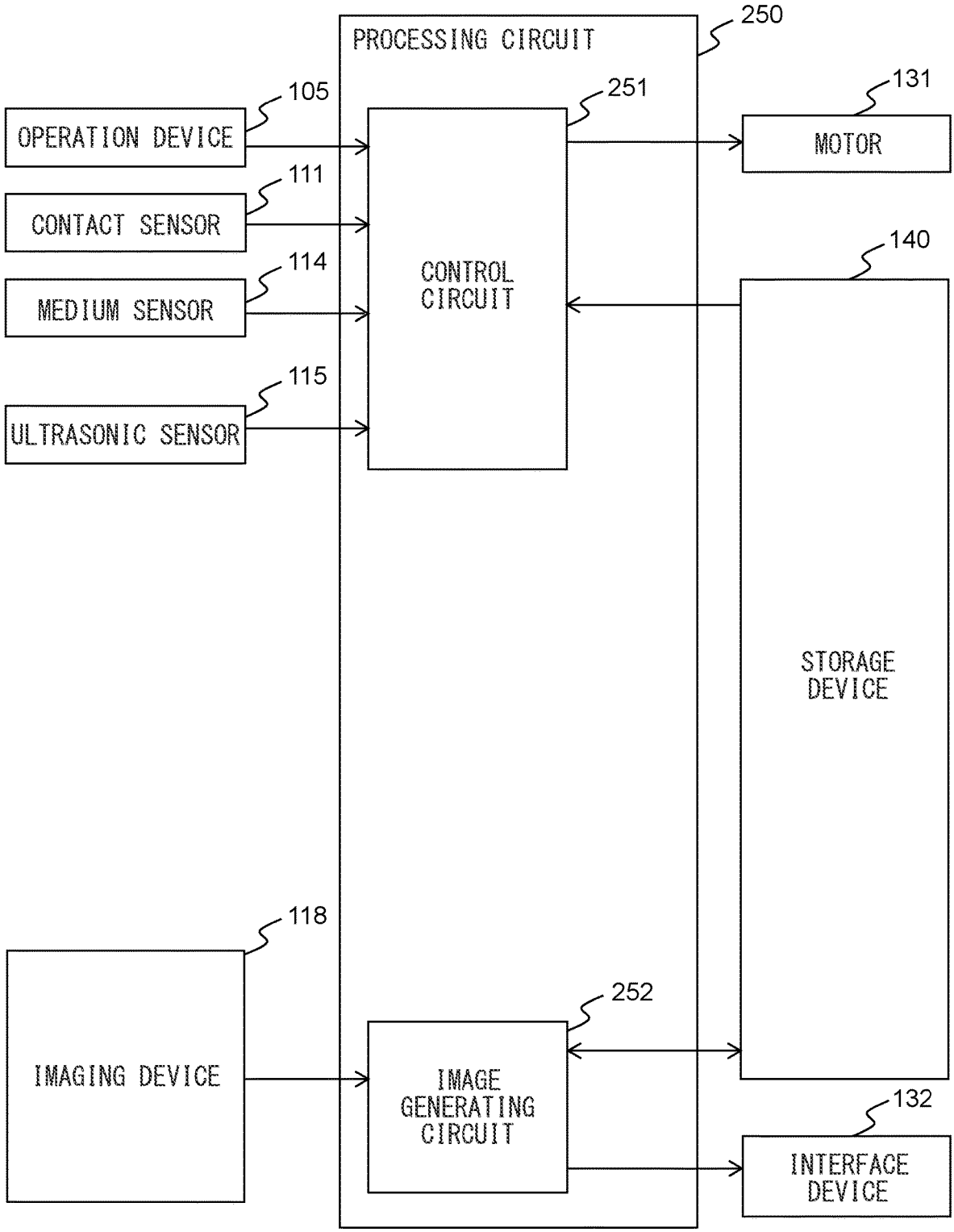
FIG. 13 is a diagram illustrating a schematic configuration of another processing circuit 250.

FIG. 13 is a diagram illustrating a schematic configuration of a processing circuit 250 in a medium conveying apparatus according to another embodiment. The processing circuit 250 is used in place of the processing circuit 150 in the medium conveying apparatus 100, and executes the medium reading processing and a control processing including various calculations and determinations in place of the processing circuit 150. The processing circuit 250 includes a control circuit 251 and an image generating circuit 252, etc. Note that each unit may be configured by an independent integrated circuit, a microprocessor, firmware, etc.

The control circuit 251 is an example of a control module and has a function similar to the control module 151. The control circuit 251 receives the operation signal from the operation device 105, the first medium signal from the contact sensor 111, and the second medium signal from the medium sensor 114, respectively, and outputs a control signal to the motor 131 to control the feeding and the conveying of the medium according to each received signal. The control circuit 251 receives the ultrasonic signal from the ultrasonic sensor 115, reads the line image from the storage device 140 executes abnormality processing for the multi-feed, based on the width of the medium acquired based on the line image and the ultrasonic signal.

The image generating circuit 252 is an example of an image generating module and has a function similar to the image generating module 152. The image generating circuit 252 receives the line image from the imaging device 118 and stores it in the storage device 140, generates the medium image, and transmits it to the information processing apparatus via the interface device 132.

As described in detail above, the medium conveying apparatus can more accurately determine whether or not the multi-feed of the medium has occurred, even when using the processing circuit 250.

According to the embodiment, the medium conveying apparatus, the method, and the computer-readable, non-transitory medium storing the control program, can more accurately determine whether or not the multi-feed of the medium has occurred.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a conveying roller to convey a medium;

a width detection sensor for detecting a width of the medium conveyed by the conveying roller in a direction perpendicular to a conveying direction;

an overlap detection sensor for detecting an overlap of the medium conveyed by the conveying roller; and a processor to determine whether to execute an abnormality processing for a multi-feed, based on the width of the medium acquired based on a detection result by the width detection sensor and a detection result by the overlap detection sensor, wherein the processor acquires an overlap detection width being a width in which the medium is estimated to overlap in the direction perpendicular to the conveying direction, based on the detection result by the overlap detection sensor, wherein the processor executes the abnormality processing when the width of the medium and the overlap detection width are equal, and wherein the processor does not execute the abnormality processing when the width of the medium is more than the overlap detection width.

2. The medium conveying apparatus according to claim 1, wherein the overlap detection sensor includes a plurality of detection sensors, and wherein the processor acquires the overlap detection width based on a detection result by the plurality of detection sensors and arrangement positions of the plurality of detection sensors.

3. The medium conveying apparatus according to claim 2, wherein the detection sensor is an ultrasonic sensor to detect a transmission intensity of an ultrasonic wave transmitted through the medium.

4. The medium conveying apparatus according to claim 1, wherein the processor acquires an overlap detection length being a length in which the medium is estimated to overlap along the conveying direction based on a detection result by the overlap detection sensor, and wherein the processor does not execute the abnormality processing when the width of the medium is more than the overlap detection width and the overlap detection length is less than a threshold.

5. The medium conveying apparatus according to claim 4, wherein the overlap detection sensor includes a plurality of detection sensors, wherein the processor acquires the overlap detection width based on a detection result by the plurality of detection sensors and arrangement positions of the plurality of detection sensors, and wherein the processor acquires the overlap detection length based on a detection result by at least one of the plurality of detection sensors.

6. A method for executing an abnormality processing, comprising:

conveying a medium, by a conveying roller;

determining whether to execute an abnormality processing for a multi-feed, based on a width of the medium acquired based on a detection result by a width detection sensor for detecting a width of the medium conveyed by the conveying roller in a direction perpendicular to a conveying direction and a detection result by an overlap detection sensor for detecting an overlap of the medium conveyed by the conveying roller, wherein an overlap detection width being a width in which the medium is estimated to overlap in the direction perpendicular to the conveying direction, is acquired based on the detection result by the overlap detection sensor, wherein the abnormality processing is executed when the width of the medium and the overlap detection width are equal, and wherein the abnormality processing is not executed when the width of the medium is more than the overlap detection width.

7. The method according to claim 6, wherein the overlap detection sensor includes a plurality of detection sensors, and wherein the overlap detection width is acquired based on a detection result by the plurality of detection sensors and arrangement positions of the plurality of detection sensors.

8. The method according to claim 7, wherein the detection sensor is an ultrasonic sensor to detect a transmission intensity of an ultrasonic wave transmitted through the medium.

9. The method according to claim 6, wherein an overlap detection length being a length in which the medium is estimated to overlap along the conveying direction is acquired based on a detection result by the overlap detection sensor, and wherein the abnormality processing is not executed when the width of the medium is more than the overlap detection width and the overlap detection length is less than a threshold.

10. The method according to claim 9, wherein the overlap detection sensor includes a plurality of detection sensors, wherein the overlap detection width is acquired based on a detection result by the plurality of detection sensors and arrangement positions of the plurality of detection sensors, and wherein the overlap detection length is acquired based on a detection result by at least one of the plurality of detection sensors.

11. A computer-readable, non-transitory medium storing a computer program, wherein the computer program causes a medium conveying apparatus including a conveying roller to convey a medium, a width detection sensor for detecting a width of the medium conveyed by the conveying roller in a direction perpendicular to a conveying direction, and an overlap detection sensor for detecting an overlap of the medium conveyed by the conveying roller, to execute a process, the process comprising:

determining whether to execute an abnormality processing for a multi-feed, based on the width of the medium acquired based on a detection result by the width detection sensor and a detection result by the overlap detection sensor, wherein an overlap detection width being a width in which the medium is estimated to overlap in the direction perpendicular to the conveying direction, is acquired based on the detection result by the overlap detection sensor, and wherein the abnormality processing is executed when the width of the medium and the overlap detection width are equal, and wherein the abnormality processing is not executed when the width of the medium is more than the overlap detection width.

12. The computer-readable, non-transitory medium according to claim 11, wherein the overlap detection sensor includes a plurality of detection sensors, and wherein the overlap detection width is acquired based on a detection result by the plurality of detection sensors and arrangement positions of the plurality of detection sensors.

13. The computer-readable, non-transitory medium according to claim 12, wherein the detection sensor is an ultrasonic sensor to detect a transmission intensity of an ultrasonic wave transmitted through the medium.

14. The computer-readable, non-transitory medium according to claim 11, wherein an overlap detection length being a length in which the medium is estimated to overlap along the conveying direction is acquired based on a detection result by the overlap detection sensor, and wherein the abnormality processing is not executed when the width of the medium is more than the overlap detection width and the overlap detection length is less than a threshold.

15. The computer-readable, non-transitory medium according to claim 14, wherein the overlap detection sensor includes a plurality of detection sensors, wherein the overlap detection width is acquired based on a detection result by the plurality of detection sensors and arrangement positions of the plurality of detection sensors, and wherein the overlap detection length is acquired based on a detection result by at least one of the plurality of detection sensors.

* * * * *